US005380011A

United States Patent [19]

Jarvis

[11] Patent Number: 5,380,011

[45] Date of Patent: Jan. 10, 1995

[54] TRANSPORTATION GAME

[76] Inventor: Gregg L. Jarvis, 17 Goldenrod Ct., Hamilton Square, N.J.

[21] Appl. No.: 69,355

[22] Filed: May 27, 1993

[51] Int. Cl.[6] ..... A63F 3/04; A63F 9/18

[52] U.S. Cl. ..... 273/254; 273/256; 273/430

[58] Field of Search ..... 273/249-254, 273/256, 430

[56] References Cited

U.S. PATENT DOCUMENTS

| | | | |
|---|---|---|---|
| 2,128,608 | 8/1938 | Goertemiller | 273/251 |
| 3,656,757 | 4/1972 | Carroll | 273/243 |
| 4,063,735 | 12/1977 | Wendel | 273/252 |
| 4,067,579 | 1/1978 | Boofer | 273/254 |
| 4,109,917 | 8/1978 | Hatcher | 273/254 |
| 4,134,591 | 1/1979 | Brooks | 273/252 |
| 4,426,084 | 1/1984 | Michel | 273/254 |
| 4,643,430 | 2/1987 | D'Aloia | 273/252 |
| 4,679,798 | 7/1987 | Dvorak et al. | 273/254 |
| 4,784,394 | 11/1988 | Sumin | 273/251 |
| 4,850,597 | 7/1989 | Milliken | 273/254 |
| 4,932,666 | 6/1990 | Corle | 273/249 |
| 4,953,872 | 9/1990 | Schultz | 273/254 |
| 4,958,837 | 9/1990 | Russell | 273/237 |
| 5,002,283 | 3/1991 | Langham et al. | 273/252 |
| 5,050,887 | 9/1991 | Kemp | 273/237 |

FOREIGN PATENT DOCUMENTS

| | | | |
|---|---|---|---|
| 645661 | 11/1950 | United Kingdom | 273/249 |
| 2257920 | 1/1993 | United Kingdom | 273/256 |
| WO8103622 | 12/1981 | WIPO | 273/251 |

*Primary Examiner*—Benjamin H. Layno

*Attorney, Agent, or Firm*—Watov & Kipnes

[57] ABSTRACT

A transportation game comprised of a map showing cities interconnected by routes divided into segments of equal length, hometowns at which the players' trucks respectively start, contract cards indicating cities at which loads are to be picked up, cities to which they are to be delivered and the fees therefor, designations in respective segments: that a penalty card is to be drawn from a stack including cards having questions related to driving safety; that a reward card is to be drawn from a stack including cards indicating that money paid from fines into a truckers escrow account is to be received; that cards having questions of a general nature are to be drawn from a stack; that the truck is at a weigh station and a chance mechanism is to be operated to determine the penalty for overweight; that the truck is at a truck stop and that a chance mechanism is to be operated to determine the amount of money to be received and also including a chance mechanism.

36 Claims, 27 Drawing Sheets

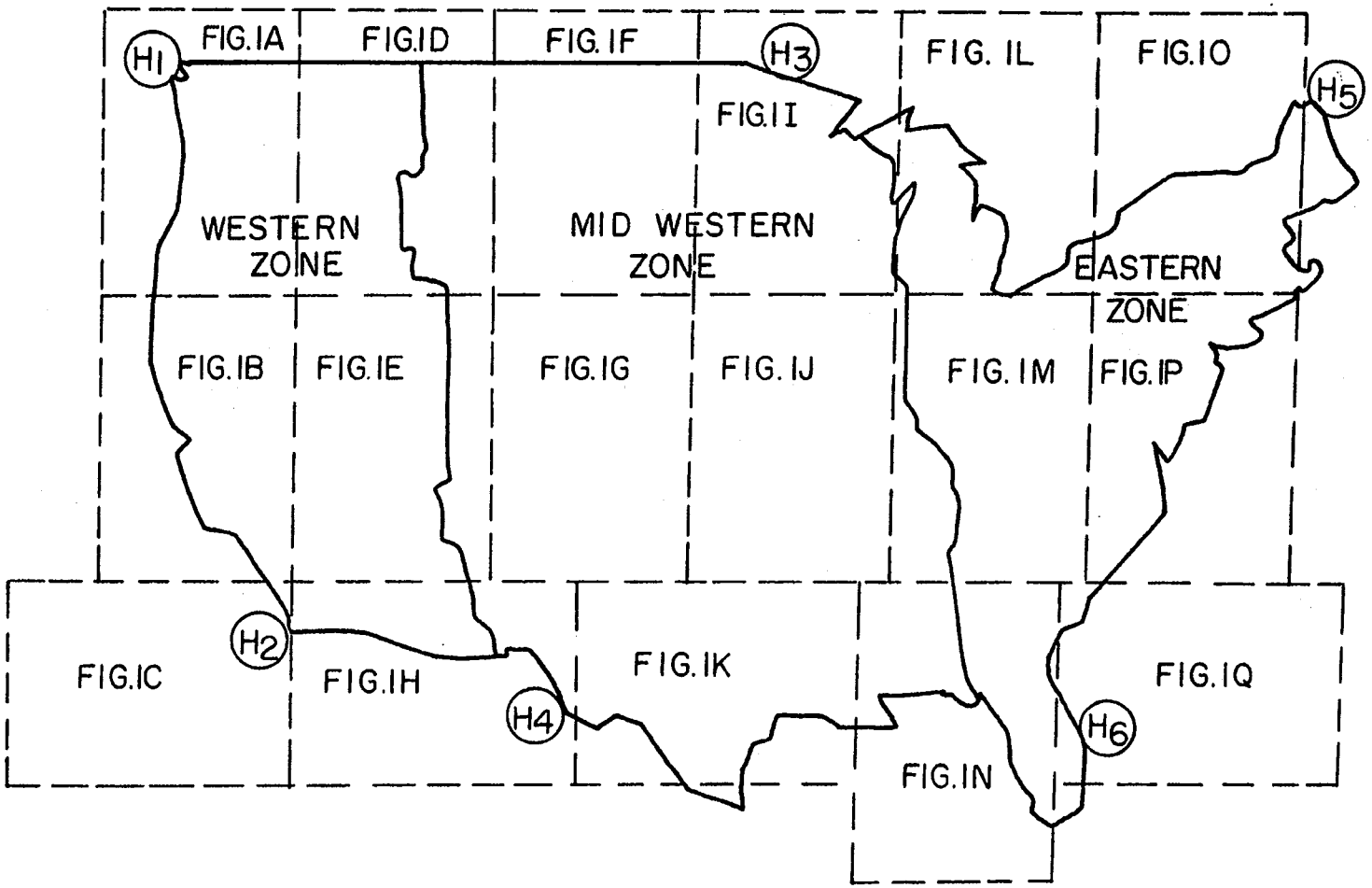
FIG. I

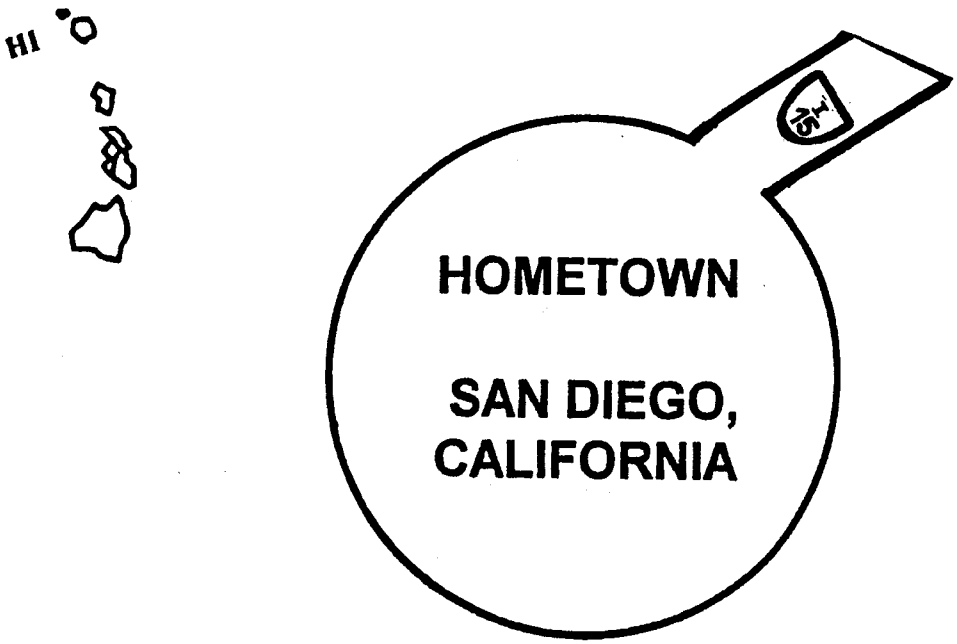
FIG. IC

AREA 1

WEST

FIG.IE
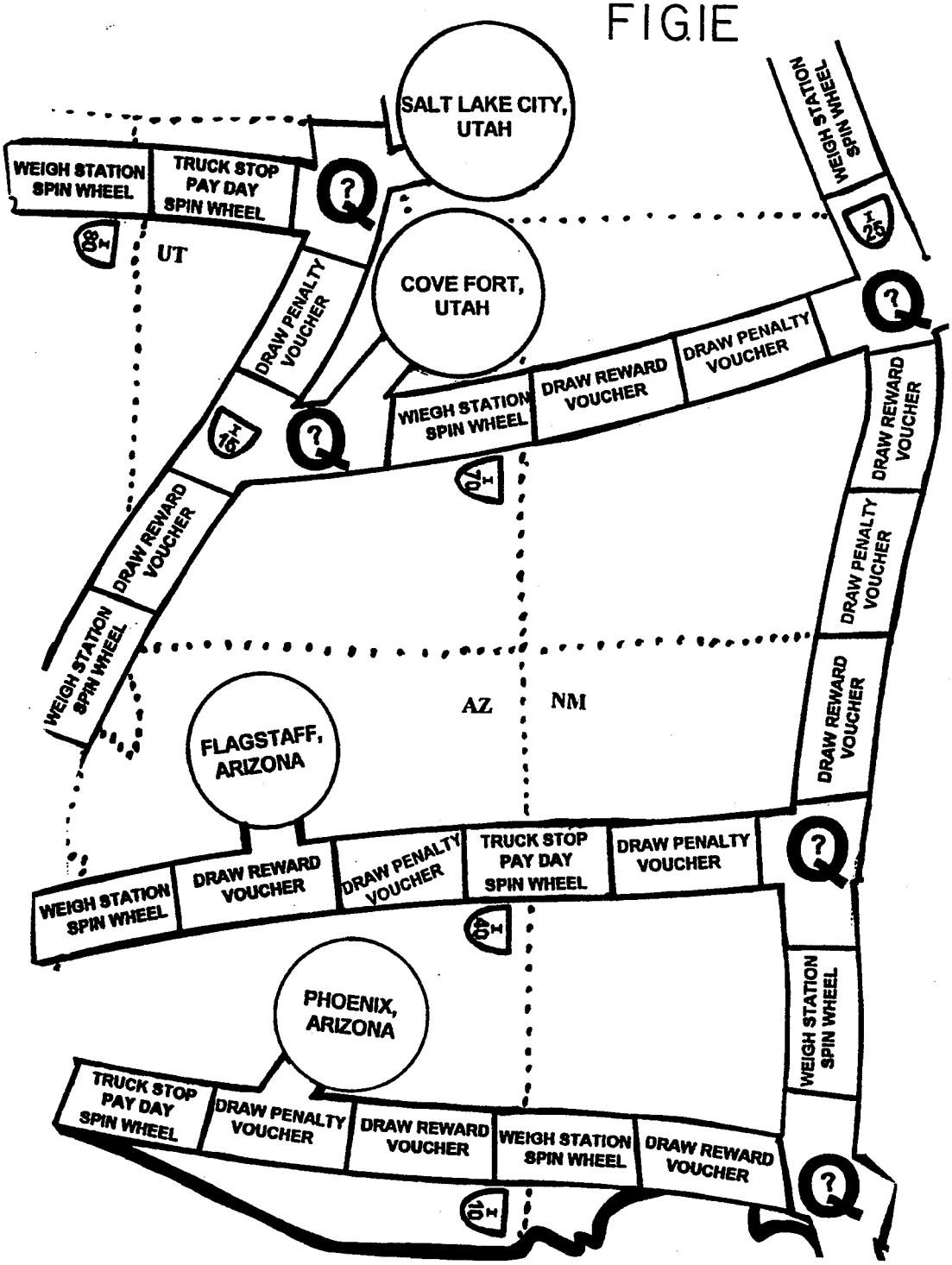

AREA II

CENTRAL

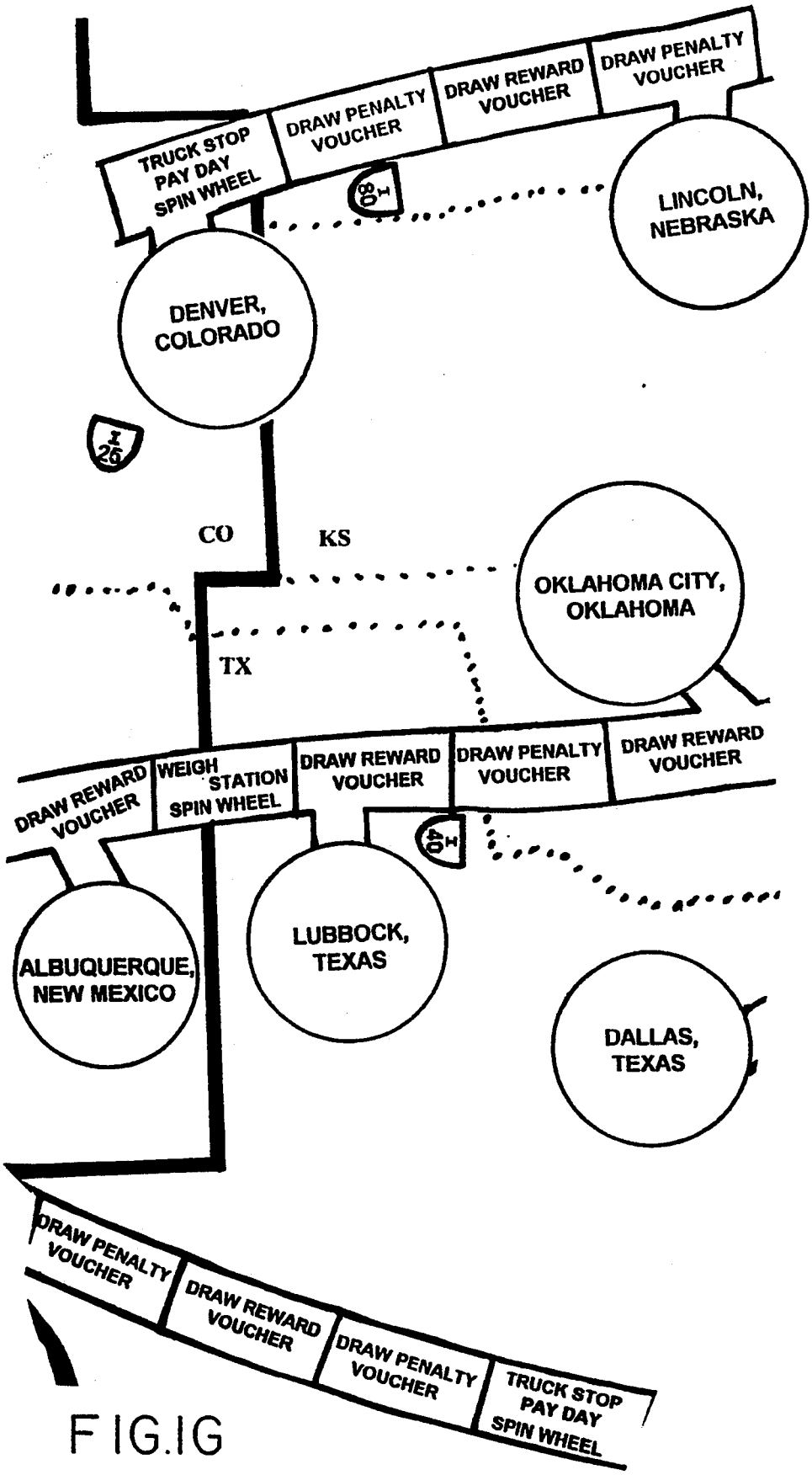
FIG.IG

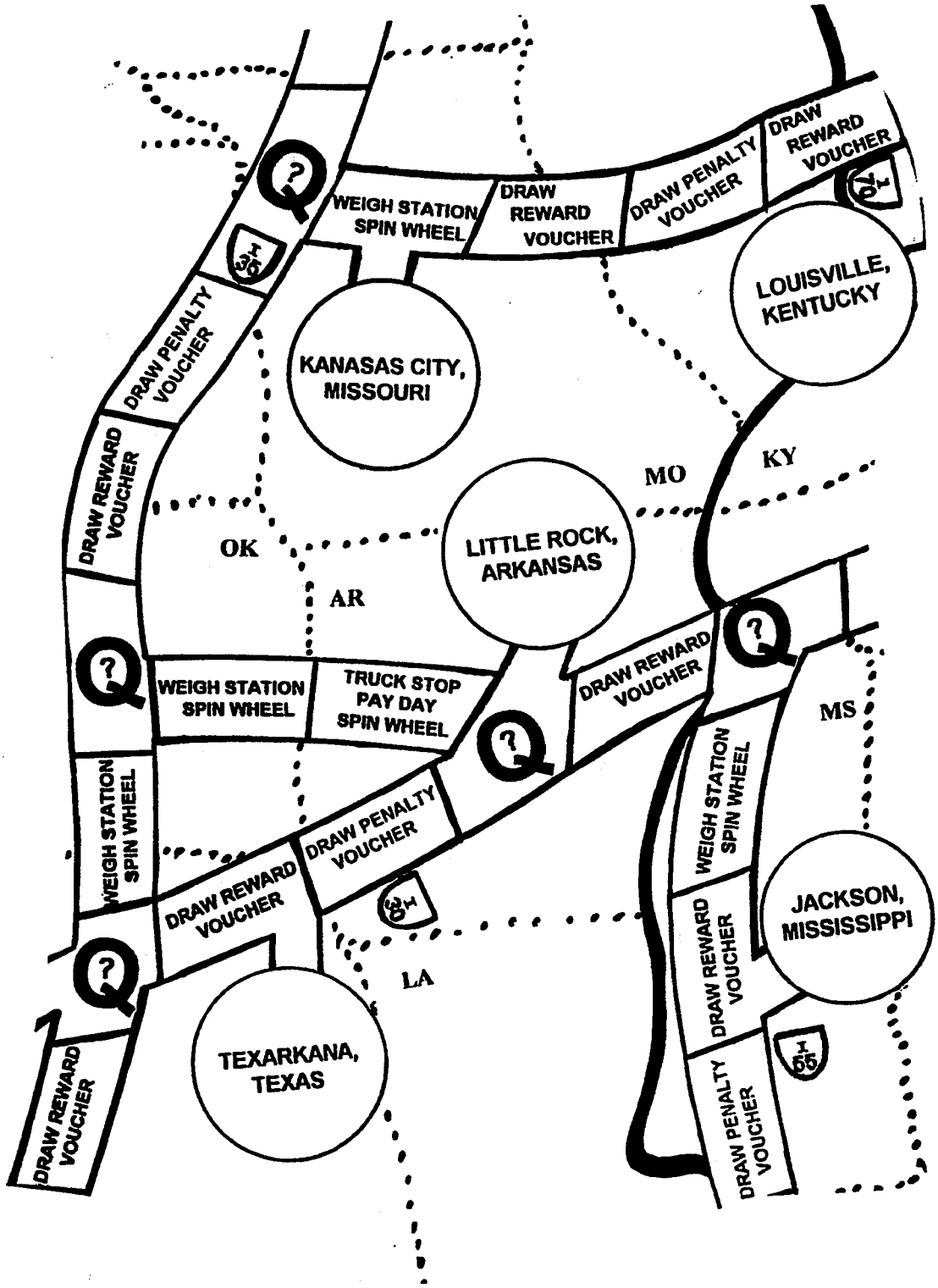
FIG. IJ

AREA III
EAST
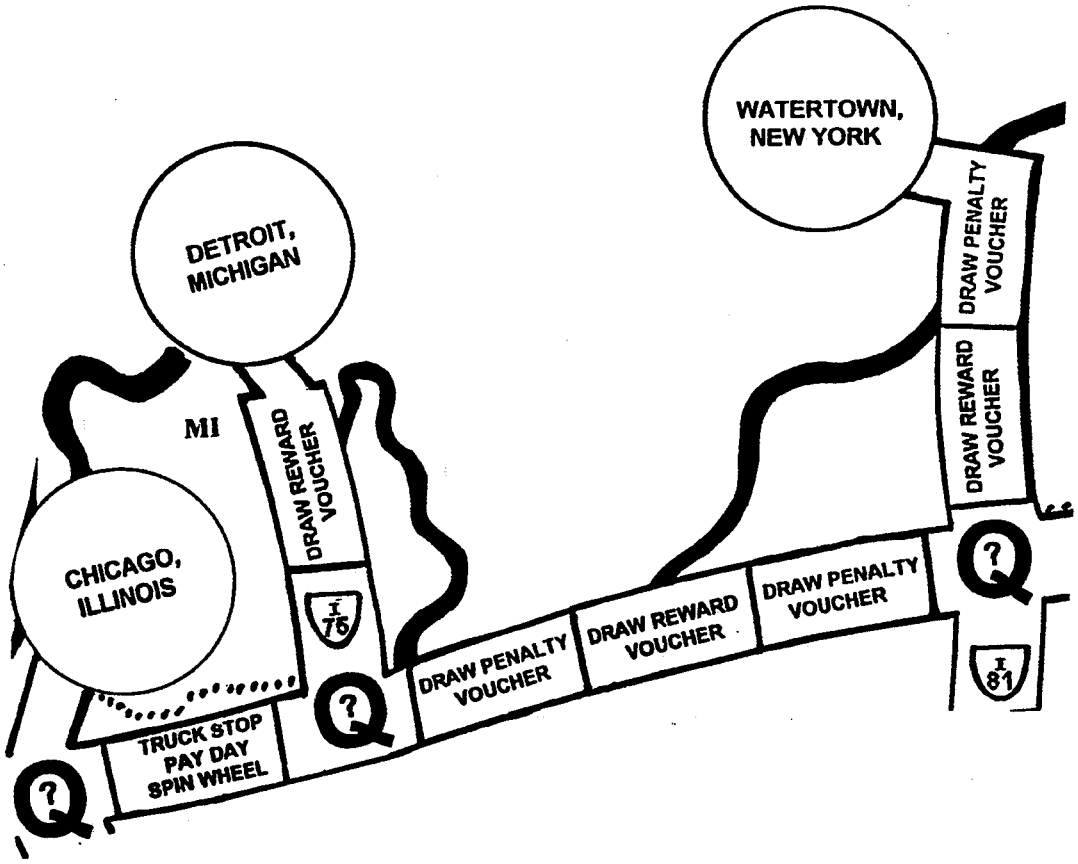
FIG. IL

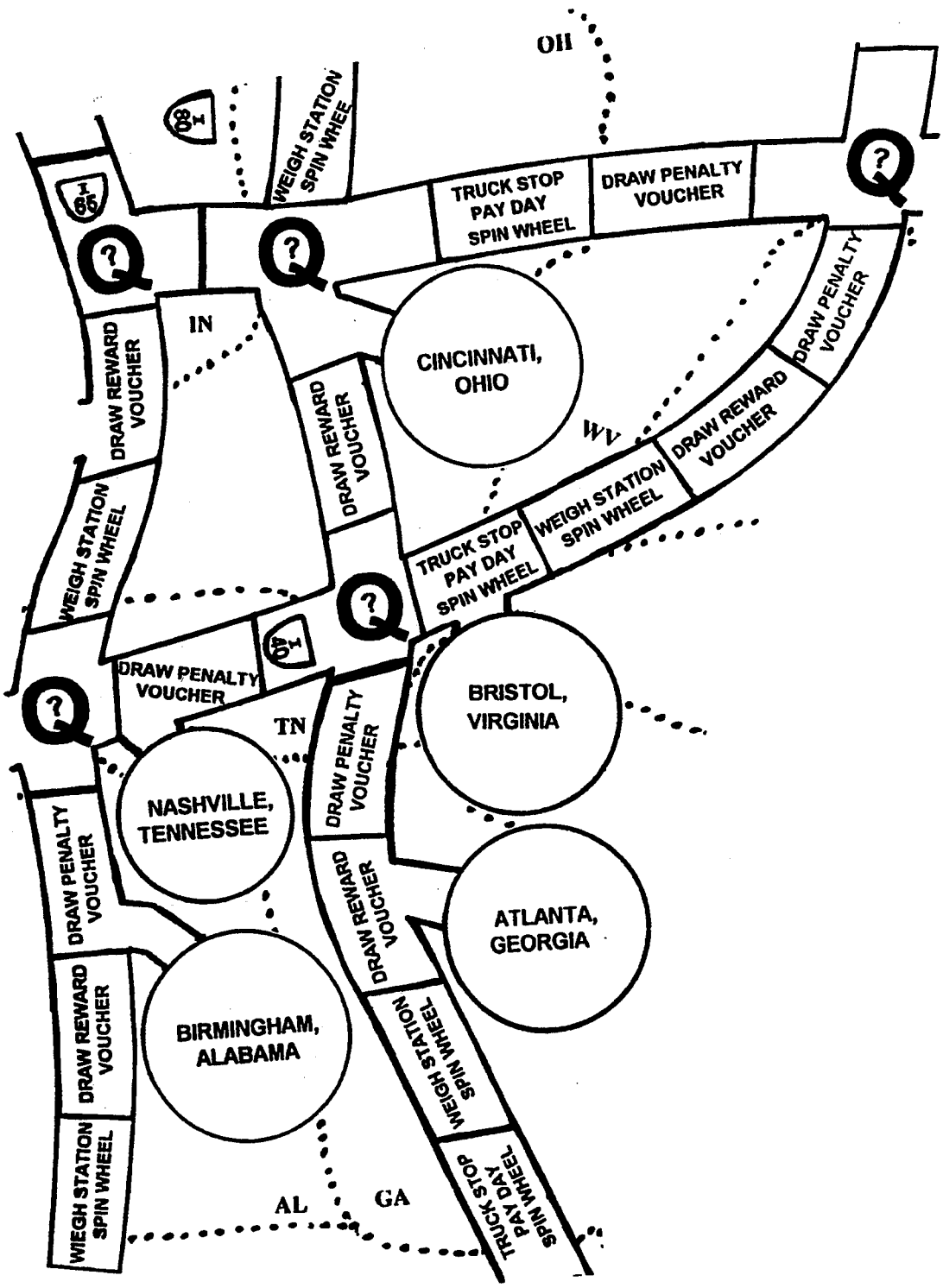
FIG. IM

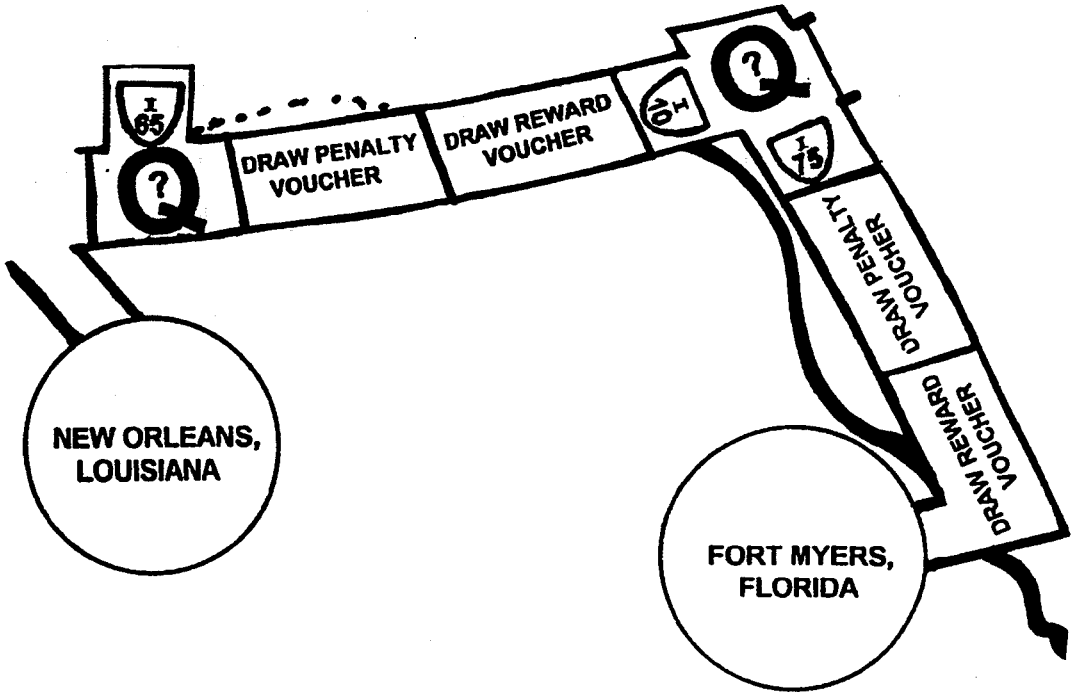
FIG. IN

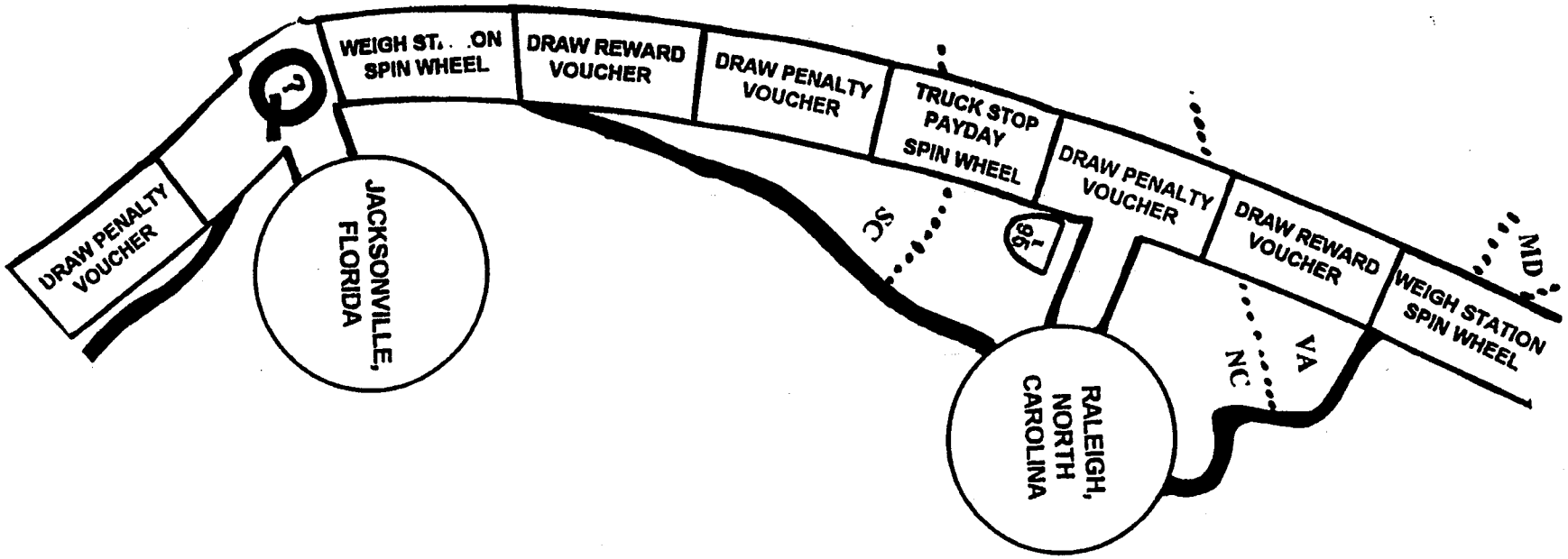
FIG. IP

OVER THE ROAD EXPRESS

CONTRACT

FOR

CARTAGE

FIG. 6A

CONTRACT FOR CARTAGE

PICK - UP :
SEATTLE, WASHINGTON
HOMETOWN

DELIVER TO :
BANGOR, MAINE
HOMETOWN

MILEAGE :
3300 (3312)

FREIGHT CHARGES - C. O. D. :
$6,600

FIG. 6B

TRANSPORTATION GAME

BACKGROUND OF THE INVENTION

A number of games are known in which each player has a piece representing a truck that is moved along a path by amounts determined at random by the throw of a die or by spinning a pointer, but for one reason or another they fail to accurately simulate the commercial trucking industry. By way of example, consider the games described in the following patents.

Hatcher, U.S. Pat. No. 4,109,917 describes a game in which pieces representing trucks are moved a number of points on interstate routes determined by the roll of dice. Symbols at each point indicate a stack of cards from which a player is to draw when the piece lands on it. The cards on each stack are for different types of rewards or penalties. No money is required for the purchase of the truck and there are no home bases as in real life. Players draw cards indicating the point of pickup, the point of delivery and the money to be paid for hauling the load from one point to the other so that there is no deadhead unpaid mileage as there is in real life.

Boofer, U.S. Pat. No. 4,067,579 describes a game in which pieces move along fixed paths between terminals at the eastern part of the USA and terminals at the west, so that the map of the U.S.A. is incidental and could be any area or no area at all. As in other such games, there are points along the routes at which rewards and penalties occur. All moneys paid as a result of certain penalties are placed in a "coffee kitty" and go to a player whose piece lands on Reno or Las Vegas.

The following U.S. patents are for games like that of Boofer in which the pieces move along arbitrary paths having no reference to any particular area: U.S. Pat. Nos. 3,656,757; 4,426,084; 4,643,430; 4,932,666; 4,953,872 and 5,002,283.

Dvorak, U.S. Patent No. 4,679,798 describes a game in which selected cities of the U.S.A. are interconnected by straight lines and first playing pieces are loaded with second playing pieces having an indicia of destination and are carried to that destination by numbers of moves determined by chance.

Russell, U.S. Pat. No. 4,958,837 describes a game played with the aid of programmed electronic controller and electronic means for displaying a map with indications of travel routes that are not shown as roads. A player can pick the starting and destination locations for his playing piece or they can be selected at random. In each turn, a player receives a reward for correctly answering a question or a penalty for an incorrect answer Brooks, U.S. Pat. No. 4,134,591 uses a map having a path with some bypasses extending around the periphery of the U.S.A. All player pieces start from their respective bases and make several round trips with movements determined with the aid of simulated radio contacts.

Wendel, U.S. Pat. No. 4,063,735 is a game in which players start at opposite ends of a highway and proceed to the other's starting point with the numbers of miles or markers to be moved in each turn determined by chance. Simulated radio communications are used to obtain information as to obstacles from the other player. The first to reach the other's starting point wins.

Kemp, U.S. Pat. No. 5,050,887 is a game simulating traffic conditions in which pieces are moved from a preselected corner to an opposing corner so as to pass through intersections.

A Milton Bradley game called "Game of the States" and briefly described in an enclosed advertisement involves moving a piece from a state determined by drawing a card for a state having opponent's products. The products are purchased at a price determined by a spinner and hauled to a destination determined by a drawn card and sold for an amount determined by a spinner.

SUMMARY OF THE INVENTION

In accordance with this invention, a game is provided that simulates the actual experiences of a trucker in a far more realistic manner than the games of the prior art. Furthermore, a player will learn valuable information about driving safety as well as interesting things about the area selected for play.

In one form of the game a playing board is provided that has a map of the U.S.A. with its principal cities interconnected with certain actual interstate highways. The highways are divided into equal segments of known mileage so that a player becomes acquainted with the actual distances involved. The segments bear indications as to whether a playing piece landing on them is subject to a reward determined by drawing a card from a first stack or a monetary penalty determined by drawing a card from a second stack. An important feature of the game is the inclusion of cards in the second stack indicating that a question card is to be drawn from a third stack. It is preferable that these questions relate to driving safety. A monetary award is made for a correct answer and a fine is levied for an incorrect answer so as to provide incentive for learning about driving safety. In addition, other segments, preferably those located at the intersections of highways, indicate that a card be drawn from a fourth stack of cards bearing questions of a general nature. Someone other than the player involved must draw cards from the third and fourth stacks because answers to the questions are printed on them. It is preferable in order to avoid confusion that the related segments and stacks of cards have the same respective colors.

Other segments along the highways indicate a weigh station at which a fine for an overloaded vehicle, determined by a chance mechanism such as a spinner is levied. Still other segments are indicated as being truck stops with a monetary reward, the amount of which is determined by a chance mechanism, such as a spinner.

In playing the game, a player selects one of a number of differently colored cards with respective imaginary names that give them title of ownership to a miniature tractor/trailer playing token, and a hometown city (home base) of the same color.

In a sequence determined by chance or agreement the players draw a Contract For Cartage card from a fifth stack that indicates the city at which a load is to be picked up, the city to which it is to be delivered, the amount to be paid and the distance between the cities. After drawing a card, a player operates a chance mechanism such as a die or, preferably, a spinner to determine the number of segments his playing piece, or truck, is to advance along a route he selects to the pickup city on his Contract card. As described above, the player receives rewards or penalties depending on the segments on which his truck ultimately lands and his or her answers to questions that may be encountered. In deadheading to a pickup city, however, no weight determination is made when a truck lands on a weighing station. In order to add interest to the game, the chance mechanism can also indicate that a player is to receive a bonus.

The money for certain fines and penalties is placed in a Trucker's Mutual Escrow Account. A player drawing a Lucky You card from the first stack, which contains reward cards, or operating the chance mechanism determining the number of segments to advance on the board in such manner that it comes to rest on a curvelinear sector with indica: "Bonus" "10" "Truckers Mutual Escrow Account", receives all the money in this account One of the players can be selected by chance as a Trustee who oversees all money transactions including furnishing the players with an initial bankroll, collecting the fines, placing certain of them in the Trucker's Mutual Escrow Account and putting money in that account after it has been awarded to a player.

In order to keep track of which playing pieces are deadheading so that they are not required to weigh in at a weigh station, removable indicia may be mounted on them.

Whereas the game may be played without dividing a playing area such as the U.S.A. into zones, it is preferable to do so and to provide corresponding stacks of Contract For Cartage cards. Thus, if the U.S.A. is divided into its western, midwestern and eastern zones, there would be three stacks of Contract For Cartage cards, one for each zone. All cards for a zone would designate a city within that zone for pickup and a city in one of the other two zones for delivery. An advantage of this arrangement is that it would tend to equalize the distances each player would have to go from his home base for the first pickup.

Further equalization is brought about by placing home bases in each of the zones with approximately the same relative locations with respect to the geographic centers of the respective zones. Thus, if home bases are located at Seattle and San Diego in the western zone, home bases could be located at Minneapolis and Laredo in the central zone and at Bangor and Miami in the eastern zone so that there would not be too great a difference in the distances between each home base and the city at which the first pickup is made. Of course, this only occurs if a player selects the first Contract For Cartage card from the stack corresponding to the zone where his home base is located. Under the rules of the game, the first card can be drawn from any stack.

The game can be played by individuals and/or by teams.

In order to simulate the experience of husband and wife teams two players may share the title of ownership of a tractor/trailer. In effect, they take successive turns in operating the chance mechanism and share the rewards and penalties. Because of having two turns for every turn of a single player they can only compete against other teams. This is called a TEAM-SHARING mode of play.

In accordance with this invention it is possible for pairs of players owning a single tractor/trailer to compete on an individual basis with each other and against players who are sole owners of a tractor/trailer in what is called a TEAM-SEPARATE mode of play. Because the pairs of players take consecutive turns, they would on average receive the rewards and benefits of only half any distance that would be traveled by a single owner. Balance is restored by their sharing all expenses and rewards related to the cost of operations of the truck as set forth below as well as the amount paid for cartage, but they are solely responsible for all gains or losses from answering questions correctly or incorrectly.

One of the advantages of either mode of team play is that it makes it easier for an adult to aid a child in playing the game. The child can learn about handling money and can be coached if desired in answering questions, of if the child is too young to answer the questions, the adult partner can answer them and explain the correct answers. The children can feel as though they are participating regardless of the amount of help they receive.

PENALTIES TO BE SHARED

1. Trip Lease
2. Tractor/Trailer Cargo Insurance
3. Brokers Fee
4. "Fill It Up"
5. Road Permits
6. Engine Overhaul
7. Bingo Card
8. Department of Transportation
A. Mechanical defects
B. Tire tread below accepted wear
C. Front end suspension out of line
9. Road Service
10. Portable Weigh Station-Spin Mileage Wheel
11. Preventive Maintenance Service The segments with indicia; WEIGH STATION—SPIN WHEEL are also shared by the team players in either mode of play.

REWARDS TO BE SHARED

1. Fuel Fill Up Exempt Voucher
2. Preventive Maintenance Exempt Voucher
3. Department of Transportation Exempt Voucher
4. Road Service Exempt Voucher
5. Overweight Exempt Voucher
6. State Fuel Tax Reimbursement ($1,000 to $5,000)
7. Fuel Bonus ($1,000 to $5,000)
8. Safety Bonus Award ($1,000 to $5,000)
9. Advance to your "Pick-Up" Destination and Collect $5,000
10. Advance to your "Delivery" Destination and Collect $5,000
11. Courteous Driver Award ($1,000 to $5,000)

The segments with indicia: TRUCK STOP, PAY DAY, and SPIN WHEEL are also shared by the two team players.

The following PENALTIES are NOT SHARED by the team players keeping their money separate:

1. SEND HOME MONEY
2. SPEED TRAP
3. TRAFFIC VIOLATION
a. Tailgating
b. Failure to stop on red signaling device.
c. Failure to use directional turn signal when changing lanes.
d. Traveling in the left lane of a three-lane highway.
e. Failure to yield the right-of-way.
f. Obstructing traffic.
4. Answer Safety Question
5. Internal Revenue Service—Tax Bill ($10,000; $15,000; $20,000; $25,000; $50,000)

The following REWARDS are NOT SHARED by the team players keeping their money separate:

1. Police Benevolent Association National Exempt Voucher

2. Internal Revenue Service Prepaid Voucher (Exempt Voucher)

3. Internal Revenue Service Reimbursement ($5,000; $10,000; $15,000; $20,000; $25,000)

4. "OVER THE ROAD EXPRESS" TM — DRIVER OF THE GAME AWARD ($50,000)

5. "OVER THE ROAD EXPRESS" TM —MILLION MILER AWARD ($50,000)

The penalty and reward cards have indicia such as clasped hands on them when the results thereof are to be shared.

Furthermore, the segments on the board with the symbol "Q" with a "?", indicate that a general question is to be drawn from the stack of QUESTION "Q" BANK cards of corresponding color by someone other than the player who is to answer the question, because the answers are on the card as well as the question. A player will receive a monetary reward if the question is answered correctly and pay a monetary penalty if answered incorrectly.

In TEAM-SEPARATE play, the monetary reward or penalty will NOT be shared by the team players. In TEAM-SHARING play, the two team players may discuss the question and agree upon an answer, remembering that TEAM-SHARING players may only compete against other TEAM-SHARING players in the game.

The winner can be the player who has the most money at a predetermined time or the player with the most money after all contracts have been fulfilled.

BRIEF DESCRIPTION OF THE DRAWINGS

Various embodiments of the present invention are described with reference to the drawings, wherein similar items are identified by the same reference designation, in which:

FIG. 6A and 6B respectively illustrate opposite sides of a Contract For Cartage Voucher;

DETAILED DESCRIPTION OF THE INVENTION

Figure 1A:
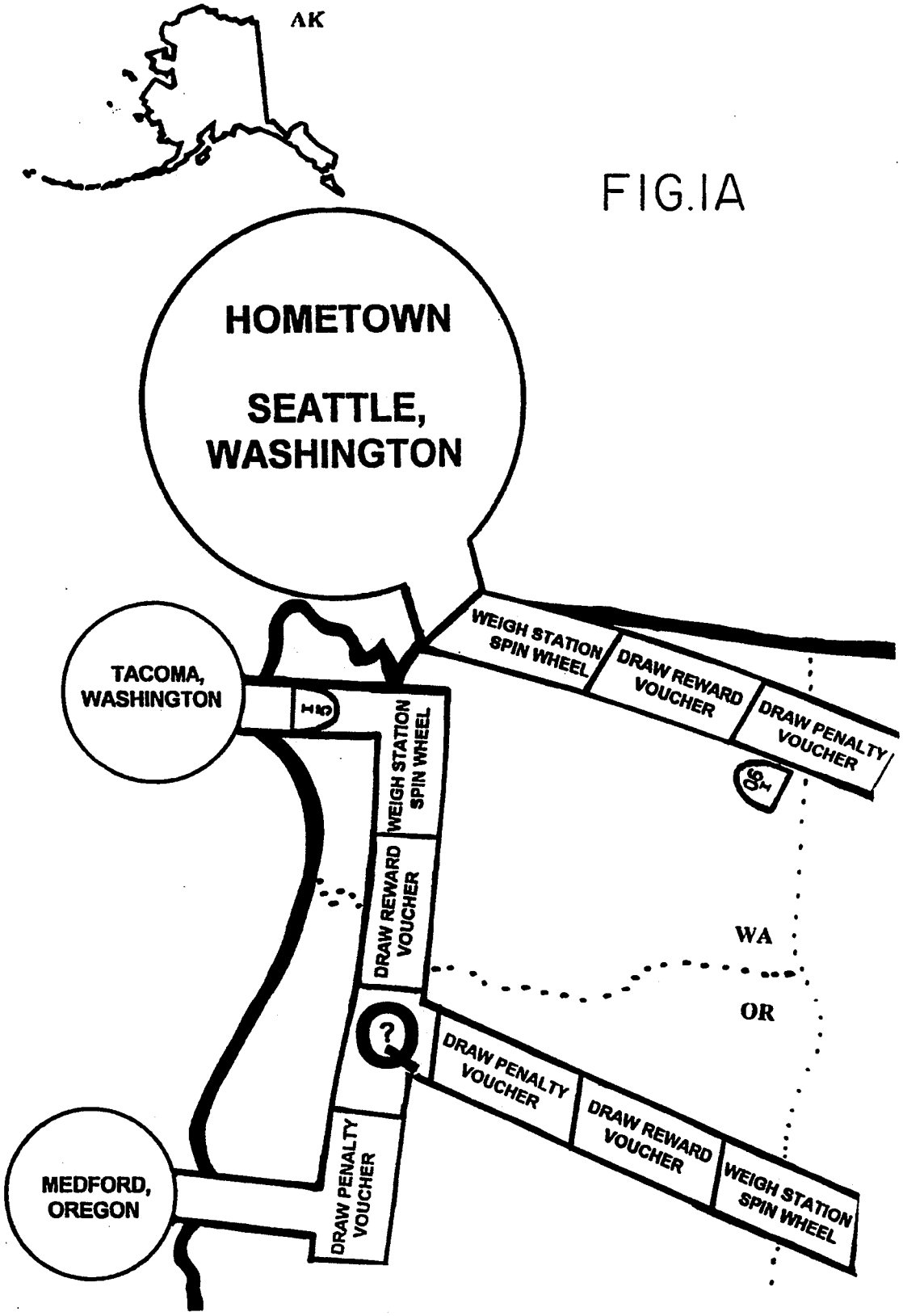
FIGS. 1A through 1Q, respectively, represent sections of a game board showing a map of the United States and a highway system.
Figure 1B:
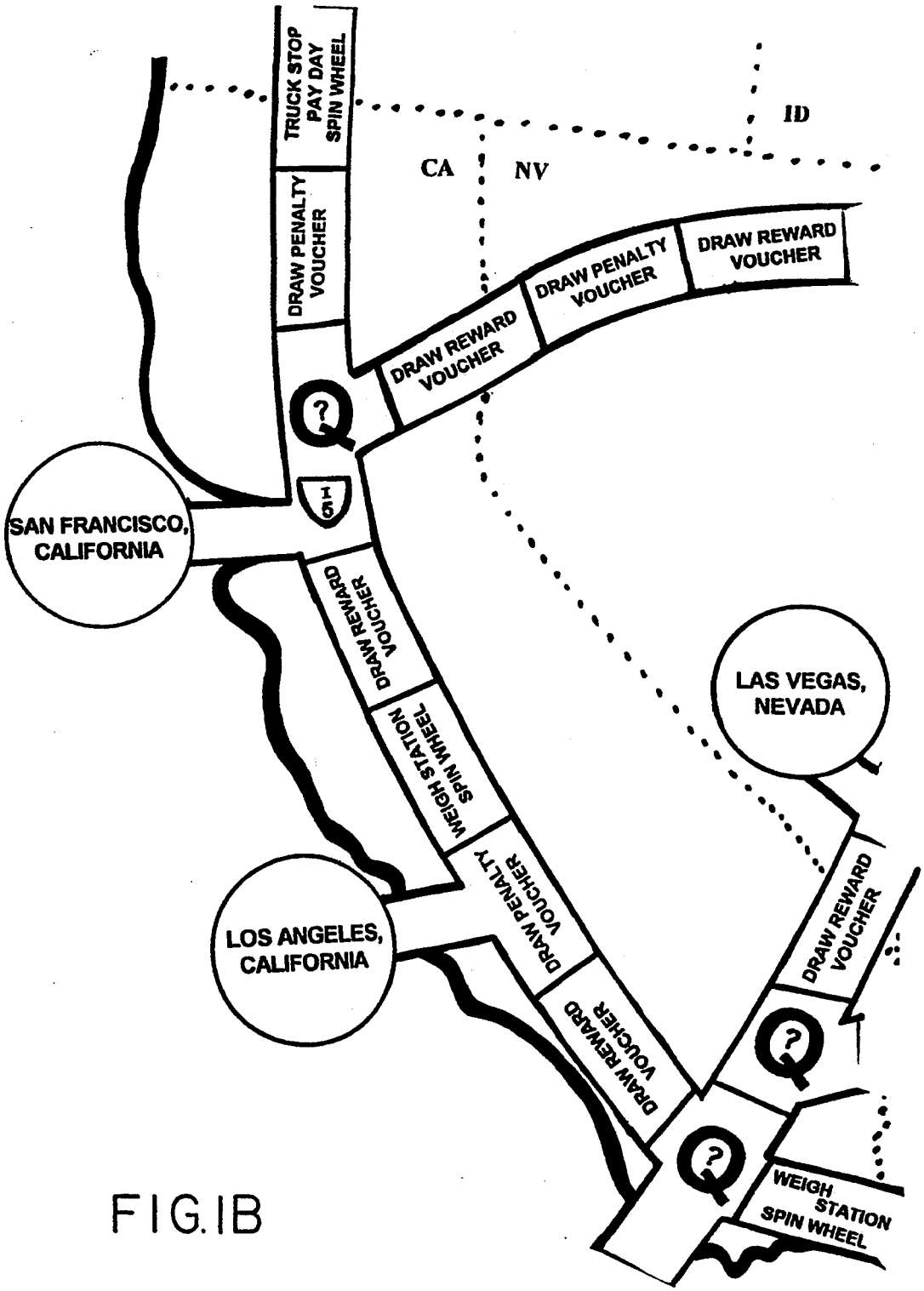
FIG. 1 is a map of the United States showing the time zones and the arrangement of FIGS. 1A through 1Q.
Figure 1D:
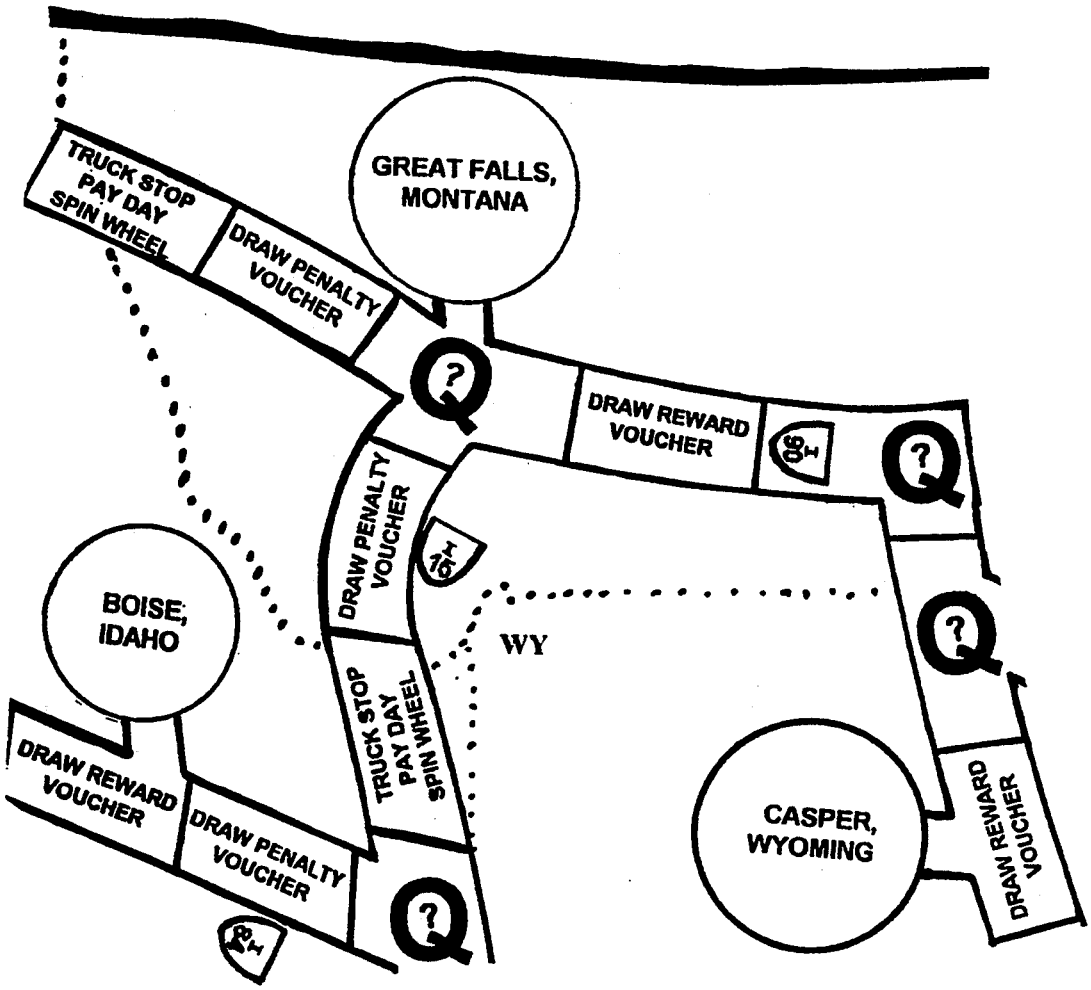
Figure 1F:
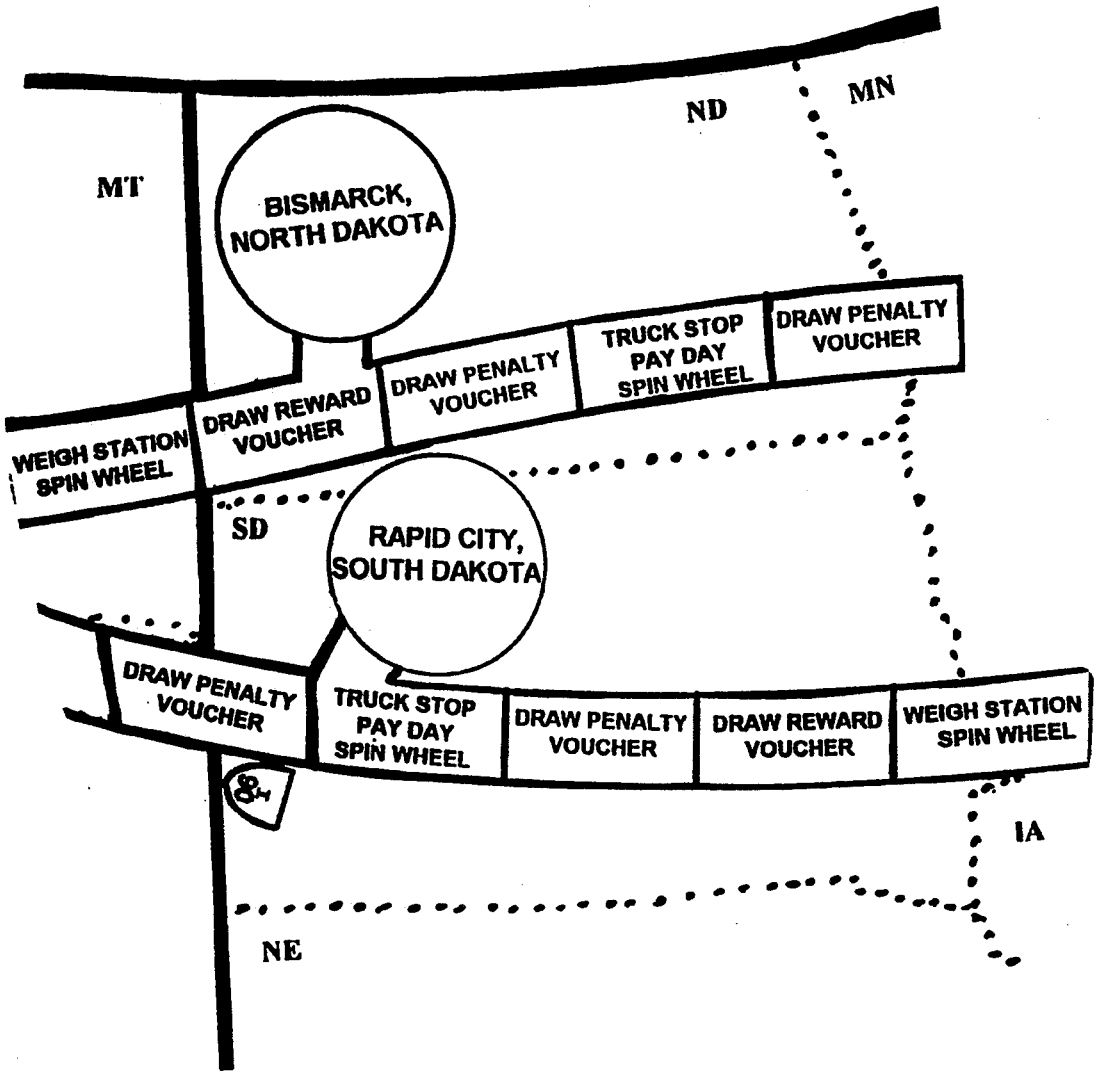
Figure 1H:
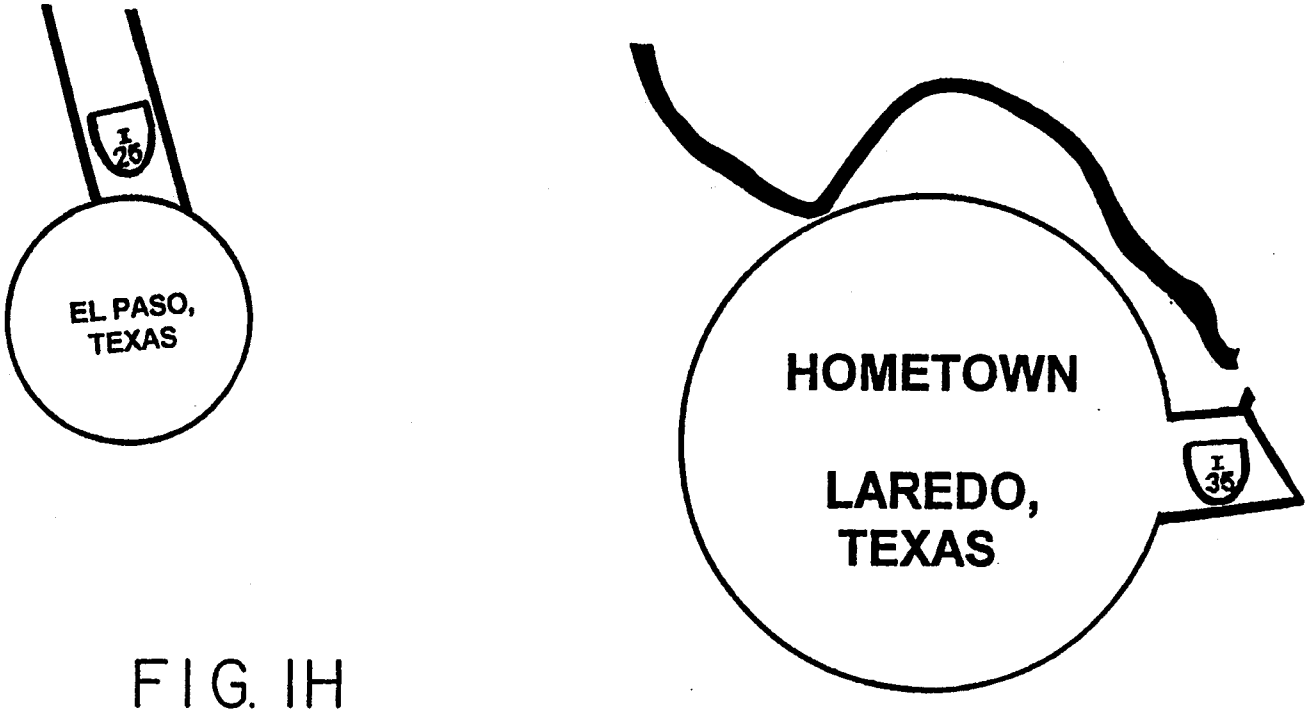
Figure 11:
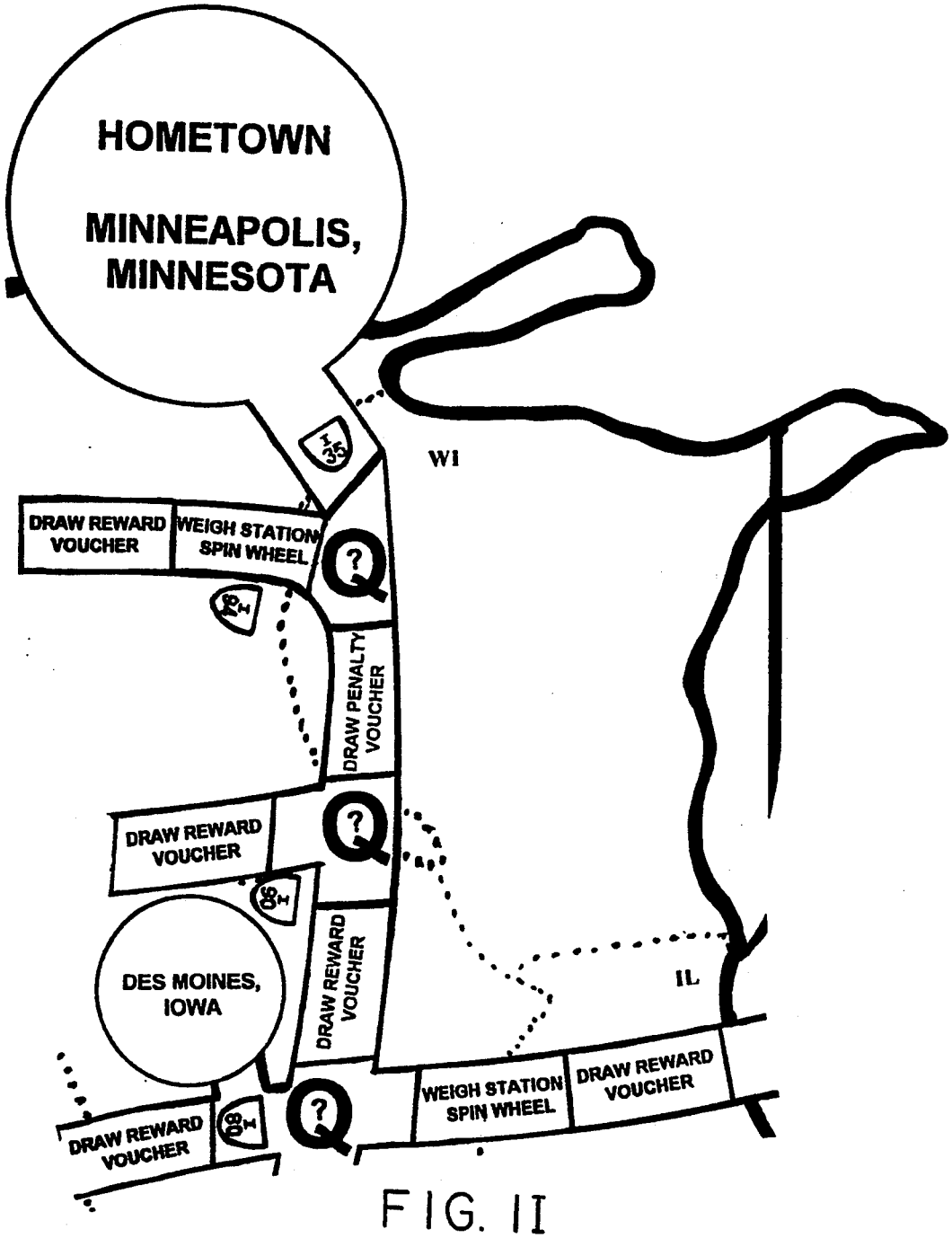
FIGS. 11A and lib respectively illustrate opposite sides of a Reward Voucher for a reward not to be shared in team play where team members retain own money.
Figure 1K:
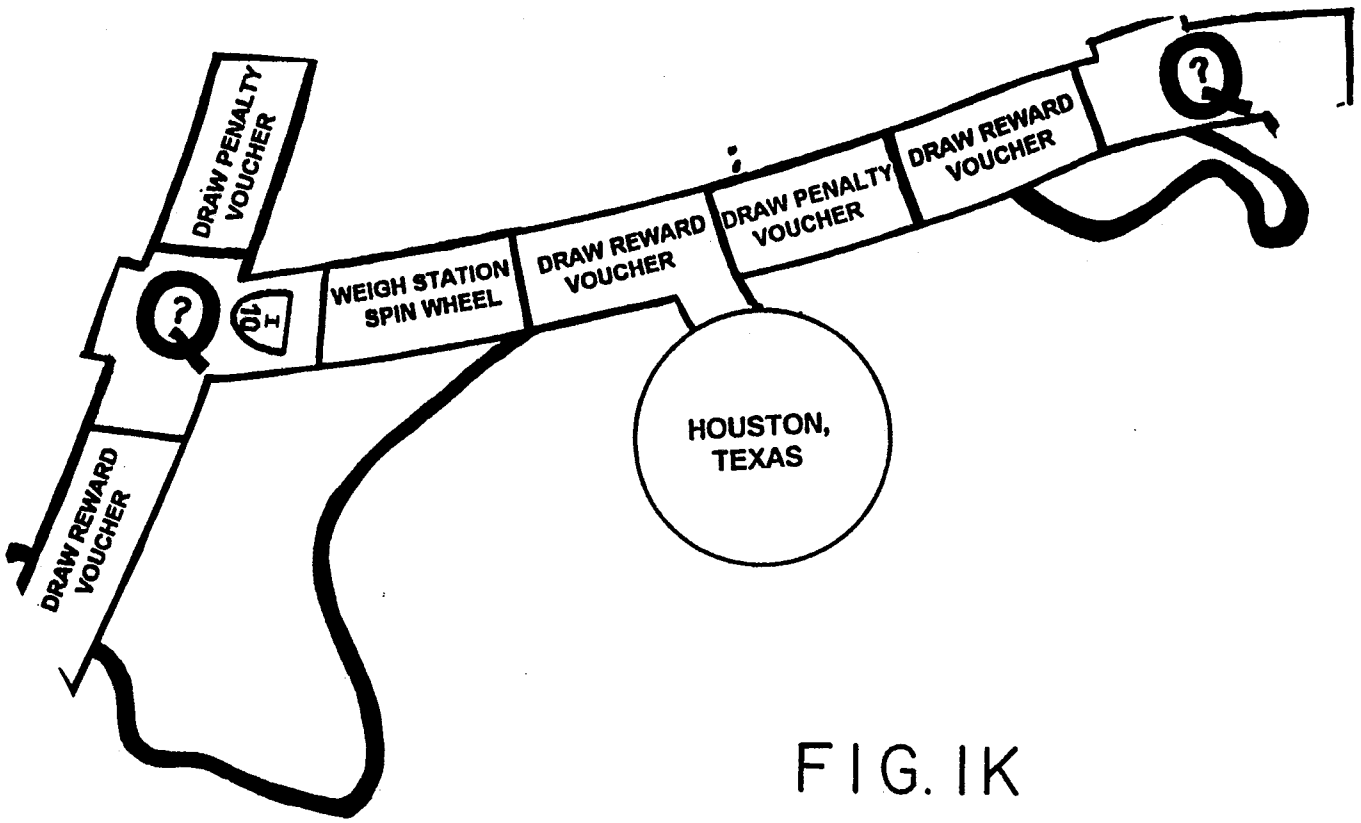
Figure 10:
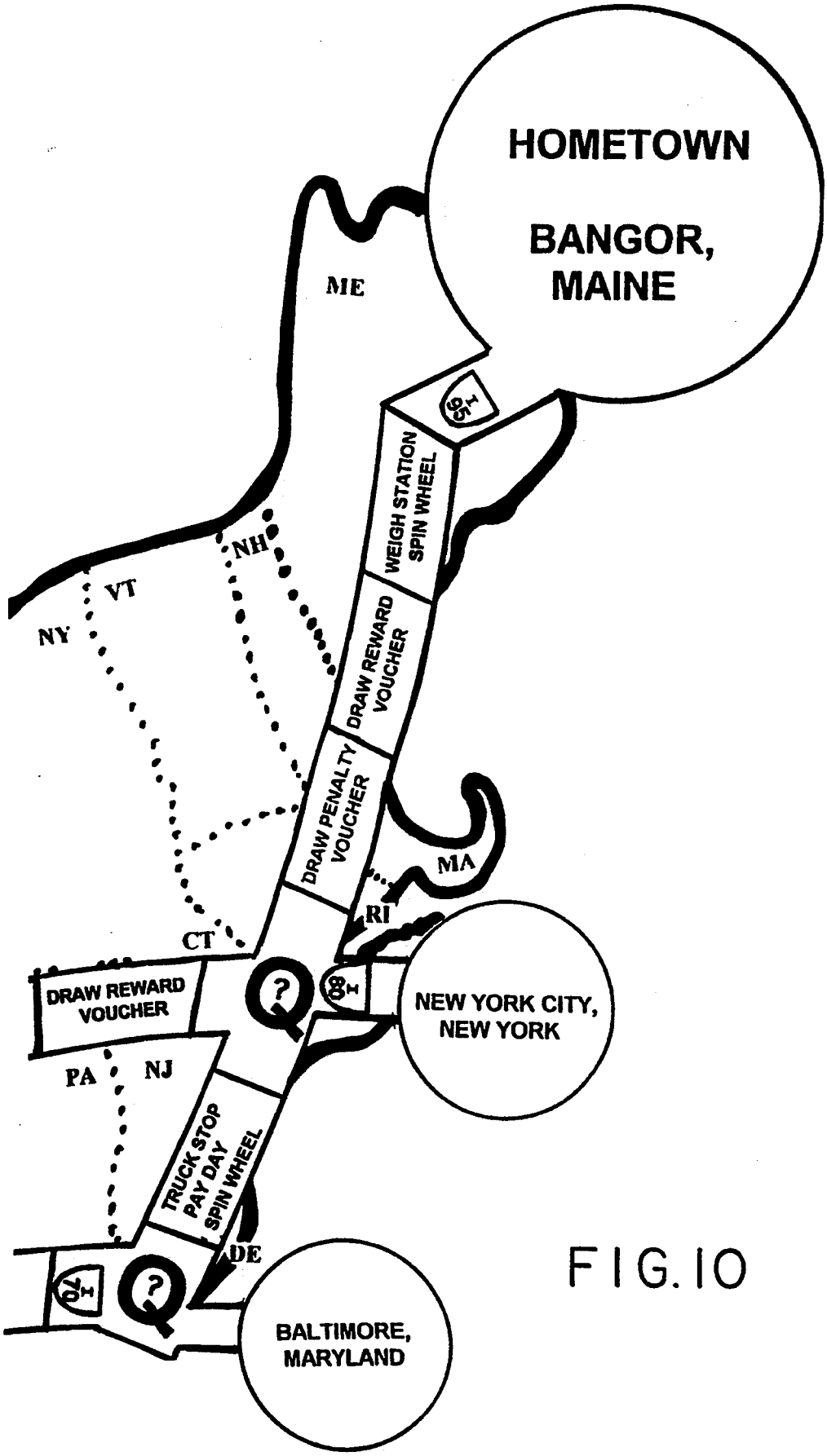
FIGS. 10A and 10B respectively illustrate opposite sides of a Reward Voucher for rewards to be shared in team play where team members retain own money.
Figure 1Q:
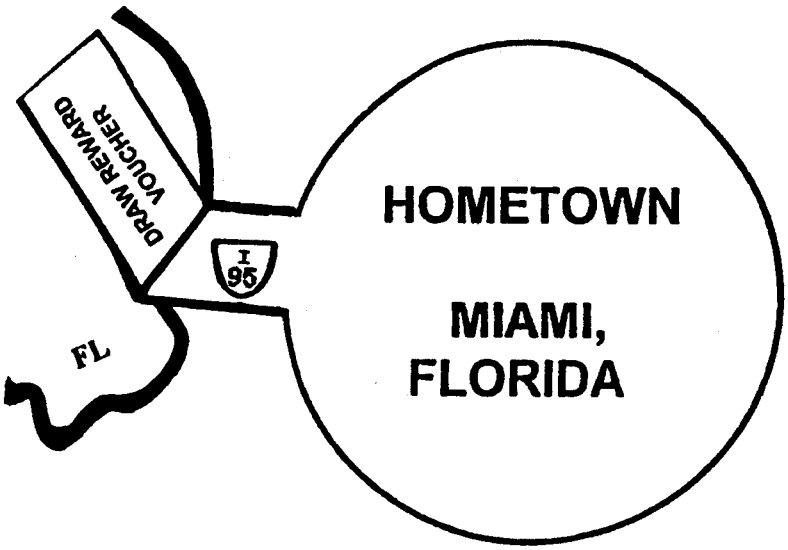

FIG. 1 illustrates the relative position of map sections of FIG. 1A through 1Q required to form a map of the U.S.A. It also indicates that the U.S.A. is divided into eastern, midwestern, central and western areas that are accurately indicated in the map sections.

With a few exceptions, the interstate routes shown on the map correspond to the actual routes. Whereas the route 80 actually goes completely across the U.S.A., the section between Denver and Salt Lake City is omitted in order to simplify the map, and for the same reason only the Section of Route I-55 between New Orleans and Louisville is shown. The other interstate routes shown are 5, 10, 15, 25, 30, 35, 40, 65, 70, 75, 81, 84, 90, 94 and 95.

Each route is divided up into colored segments having written instructions therein such as DRAW PENALTY VOUCHER, DRAW REWARD VOUCHER, WEIGH STATION—SPIN WHEEL and TRUCK STOP—PAY DAY—SPIN WHEEL and segments marked with a "Q" indicating that a general question card is to be drawn from the question bank. Preferably, the latter segments occur at intersections. Although all segments are not of the same length, they are close to it and such that the number between cities multiplied by 100 will give the approximate distance between them.

HOMETOWNS H1, H2, H3, H4, H5 and H6 are indicated in FIG. 1 by circles and are respectively located at Seattle, San Diego, Minneapolis, Laredo, Bangor and Miami. Although there actually is a highway between Seattle and Tacoma, Wash., none is shown. The reason for this is that if a player whose piece or truck is at one of them draws a Contract for Cartage card having the other as a pickup city, it would give him an unfair advantage. For the same reason no highway is shown between Miami and Fort Myers, Fla. One of the cities in each pair could be omitted, but they are so well known that they should be included.

Figure 2:
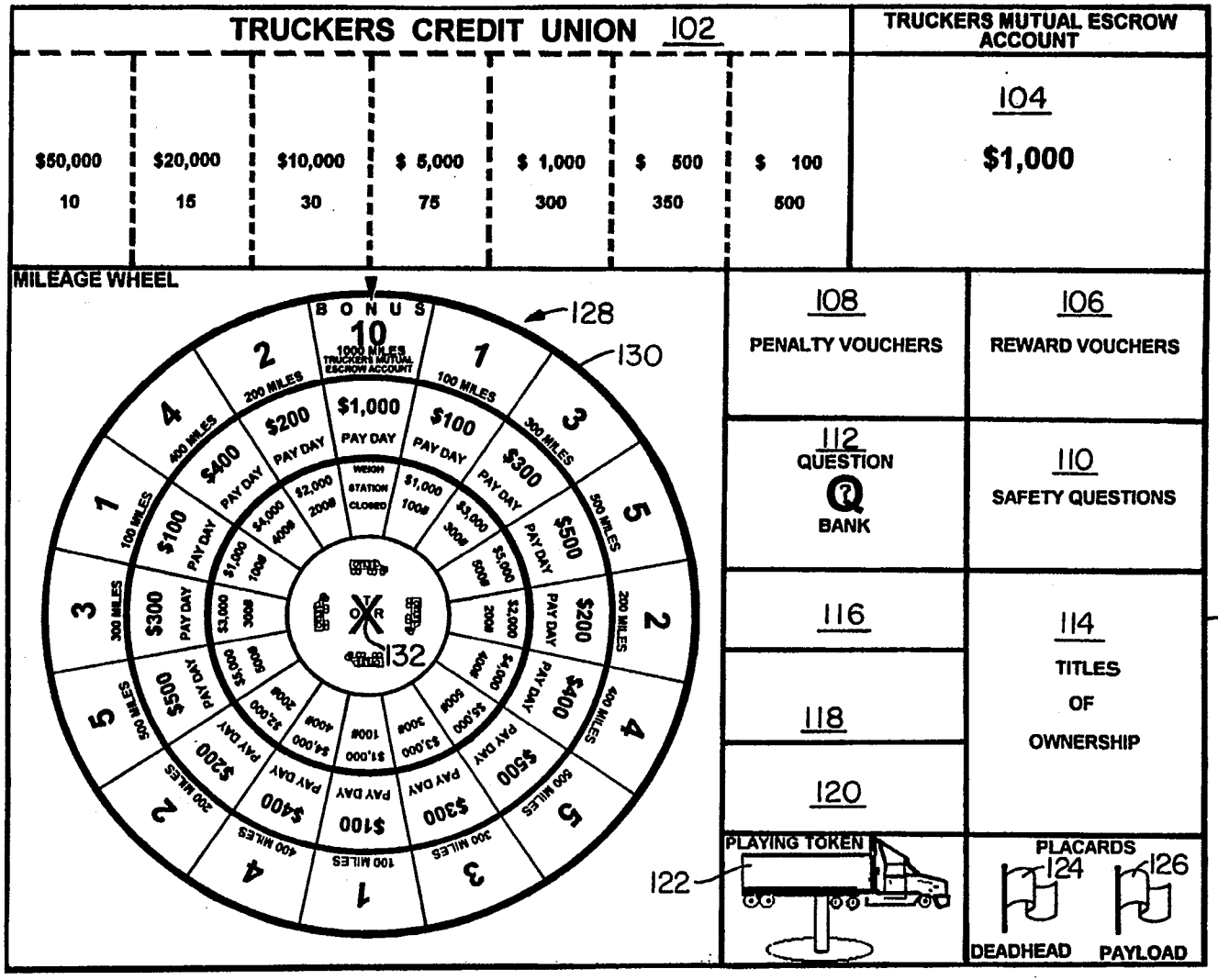
FIG. 2 identifies all the components of the game except the map illustrated by FIGS. 1A through 1Q.

FIG. 2 shows all the physical components of a game incorporating this invention as they might appear in a box 100 in which the game is sold. Play money 102 of different denominations is initially held by a Trucker's Credit Union in the amount suggested below in which K=1,000.

| NUMBER | | | TOTAL |
|---|---|---|---|
| | K | = | $1,000 |
| 10 | $50K | = | $500,000 |
| 15 | $20K | = | $300,000 |
| 30 | $10K | = | $300,000 |
| 75 | $5K | = | $375,000 |
| 300 | $1K | = | $300,000 |
| 350 | $½K | = | $175,000 |
| 500 | $100 | = | $50,000 |

Figure 5B:
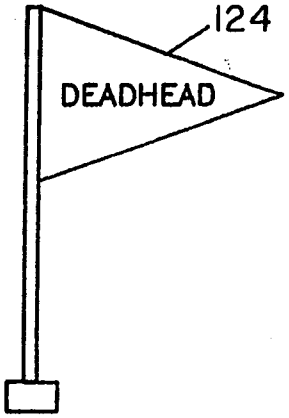
FIG. 5B illustrates a deadhead flag.
Figure 5C:
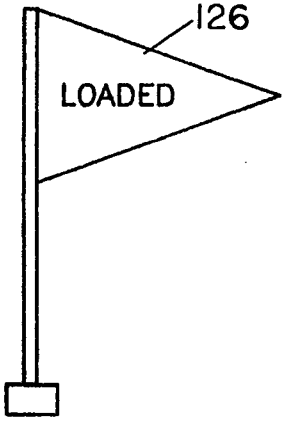
FIG. 5C illustrates a loaded flag.
Figure 5A:
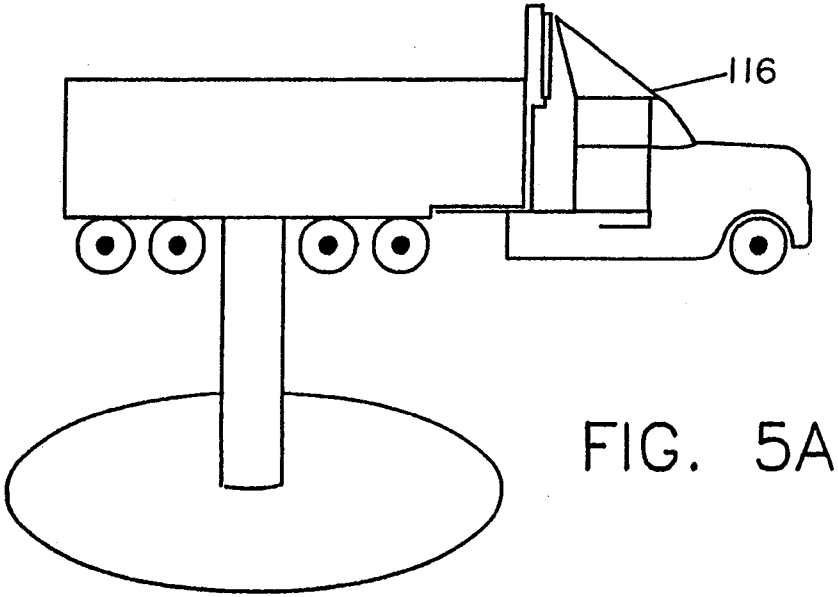
FIG. 5A illustrates a playing piece.
Figure 7:
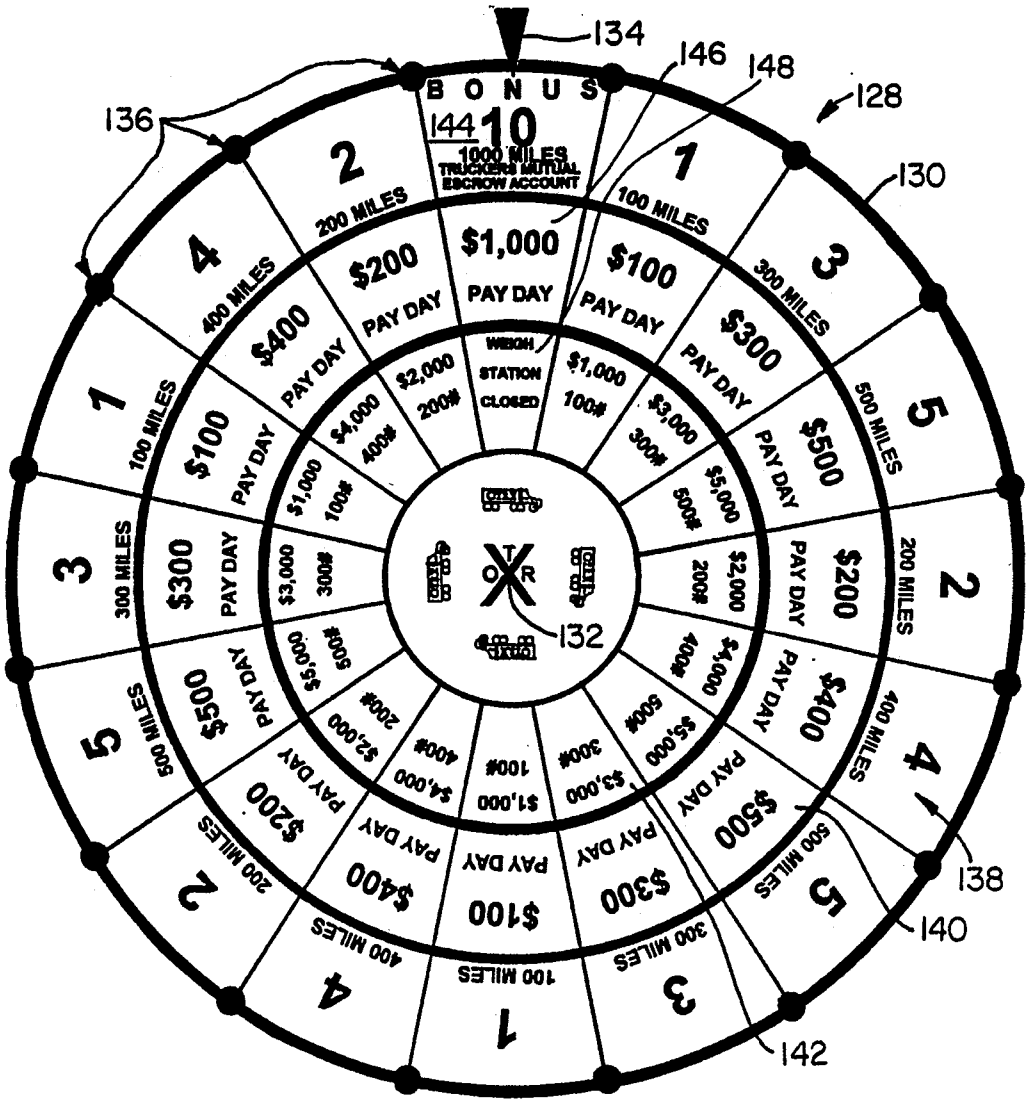
FIGS. 7 illustrates a mileage wheel.

The numeral 104 indicates a location for money in a Trucker's Mutual Escrow Account. Reward voucher cards are indicated at 106, penalty voucher cards at 108, safety question cards at 110, and general question cards at a Question Bank 112. Title of ownership cards are indicated at 114, and there are stacks of Contract For Cartage cards at 116, 118 and 120, respectively. Although only one is shown, a plurality of playing pieces or playing tokens such as indicated at 122 are provided as well as placards such as 124 to be attached to a deadheading truck and placards such as 126 to be attached to a loaded truck. Larger images of a truck 122, a deadhead placard 124 and a loaded placard 126 are respectively shown in FIGS. 5A, 5B and 5C. A chance mechanism 128 to be described in detail in connection with FIG. 7 is shown as being in the form of a disc 130 mounted for rotation at its center 132.

Figure 3B:
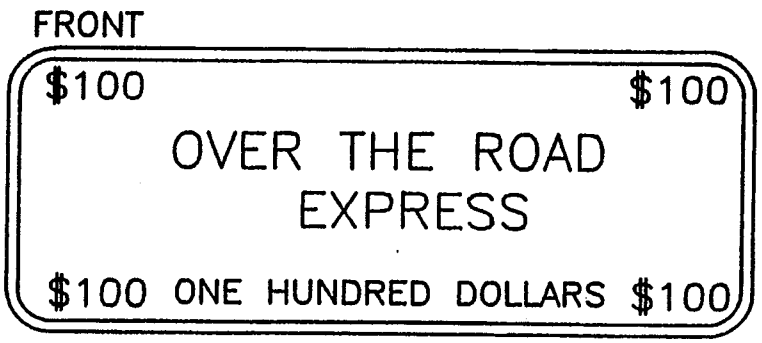
FIGS. 3A and 3B respectively illustrate opposite sides of $100 play money bill to be used in the game.
Figure 3A:
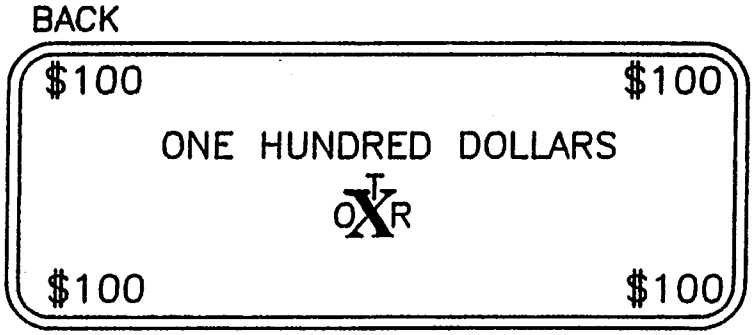

Although different designs can obviously be used for play money, front and back sides of a $100 bill are shown by way of example in FIGS. 3A and 3B, respectively.

Figure 4B:
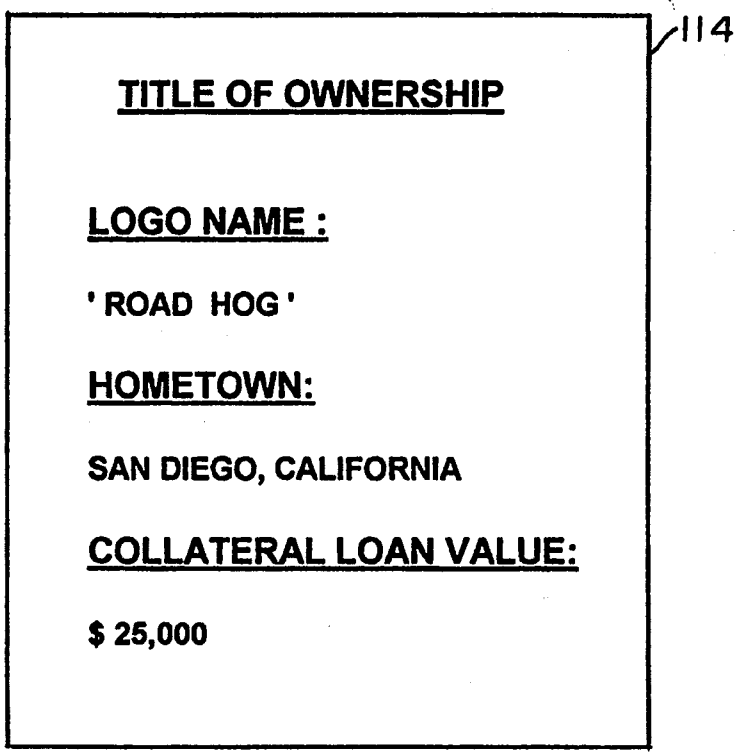
FIGS. 4A and 4B respectively illustrate opposite sides of a Title of Ownership.
Figure 4A:
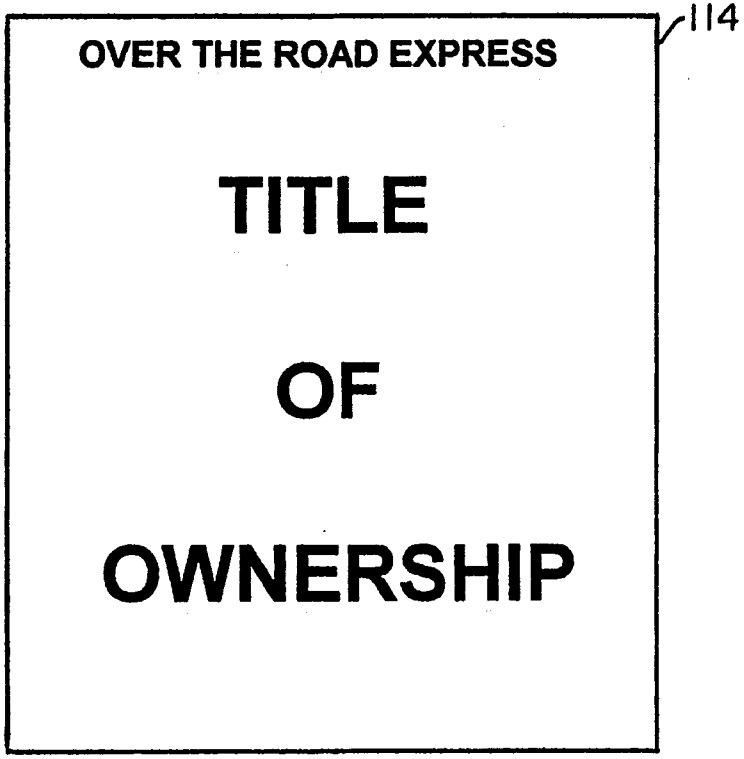

FIG. 4A shows the top side of a Title of Ownership card 114 and FIG. 4B is a view of the bottom side. The card displays the name of the truck, its hometown and its collateral value. There are as many of these cards as there are trucks 122 and Hometowns H1 through H6. Corresponding cards, trucks and hometowns are respectively similarly coded, as by color.

A top view of a Contract For Cartage card such as in one of stacks 116, 118 or 120 of FIG. 2 is shown in FIG. 6A, and a bottom view is shown in FIG. 6B. In the bottom view of the particular card shown, Seattle, Wash. is the city where the load is to be picked up, and Bangor, Me. is the city to which the load is to be delivered. The amount to be paid for cartage is indicated as being $6,600, the mileage as determined by the numbers of segments as 3,300 miles and the actual mileage as (3,312) miles. The reason for displaying the actual mileage is to break a tie that might occur when players have the same money and same number of total segments traveled.

FIG. 7 illustrates a form of chance mechanism 128 that can be used in the game of this invention. It is constructed like a roulette wheel 130 that spins freely about the axis 132 and is slowed down by a flexible member 134 bearing against pins 136 that extend perpendicularly from the wheel 130 at uniformly spaced points around its periphery. The wheel 130 is divided into sectors defined by the pins 136, and the sectors are divided into outer, middle and inner annular rings 138, 140 and 142. Thus, each annular ring is divided into curvelinear rectangles.

The rectangles in the outer ring 136 contain numbers corresponding to the number of segments and mileage a tractor/trailer is to move when the wheel 130 comes to rest with the flexible member 134 within it. In the position of the wheel 130 shown, the member 134 is positioned within a rectangle 144 having the number 10 therein and one thousand miles printed on it, meaning that the tractor/trailer is to be moved ten segments which is the same as approximately one thousand miles. Also printed in the rectangle 144 is the BONUS, which, as will be explained, authorizes the player to receive all the money in the trucker's mutual escrow account and to receive another turn.

The rectangles in the middle ring 140 contain dollar amounts. When a tractor/trailer comes to rest on a segment in a route bearing the indicia, TRUCK STOP—PAY DAY—SPIN WHEEL, the player spins the wheel 130 and receives from the TRUCKERS' CREDIT UNION account the dollar amount in a rectangle of the middle ring 140 that is within the sector in which the flexible member 134 lies. Thus, if the wheel ends up in the position shown, a rectangle 146 of the middle ring 140 lies on the sector where the member 134 resides so that the player will be entitled to $1,000.

The rectangles in the inner ring 142 contain specified dollar amounts and weights. When a tractor/trailer comes to rest on a segment on a route marked WEIGH STATION, the player spins the wheel 130 and pays the dollar amount in the rectangle of the innermost ring 142 that is within the sector in which the member 134 resides. Thus, in the example shown, the player is lucky because the rectangle 148 indicates WEIGH STATION CLOSED so that no payment is made.

Figure 8A:
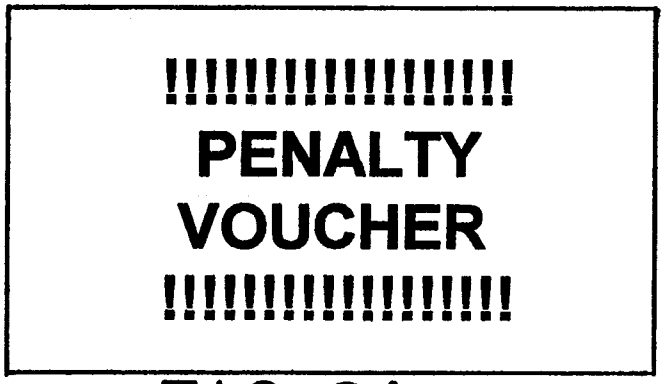
FIGS. 8A and 8B respectively illustrate opposite sides of a Penalty Voucher for a penalty to be shared in team play where team members retain own money.
Figure 8B:
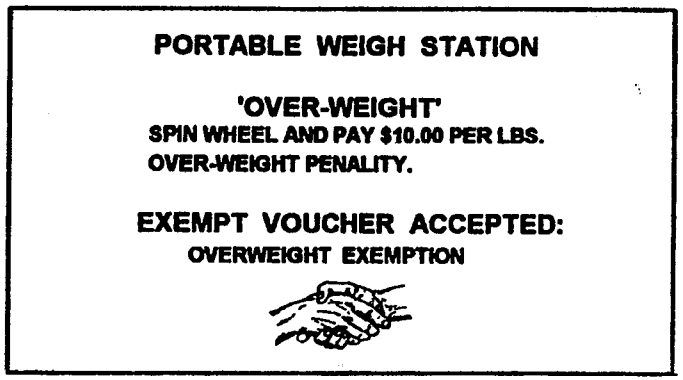

FIGS. 8A and 8B respectively show the top and bottom of one of the PENALTY VOUCHER cards 108 that, as indicated by the clasped hands is to be shared in the TEAM SEPARATE mode of play.

Figure 9A:
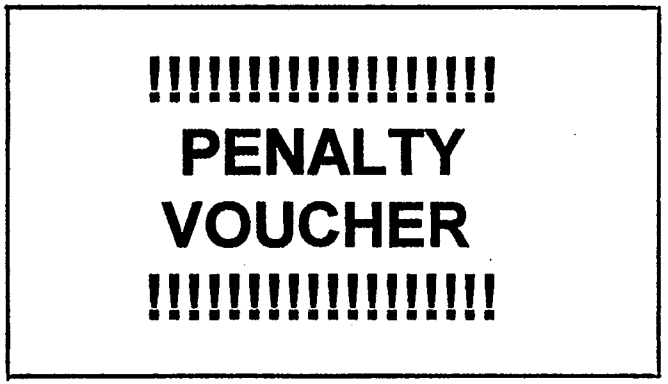
FIGS. 9A and 9B respectively illustrate opposite sides of a Penalty Voucher for a penalty not to be shared in team play where team members retain own money.
Figure 9B:
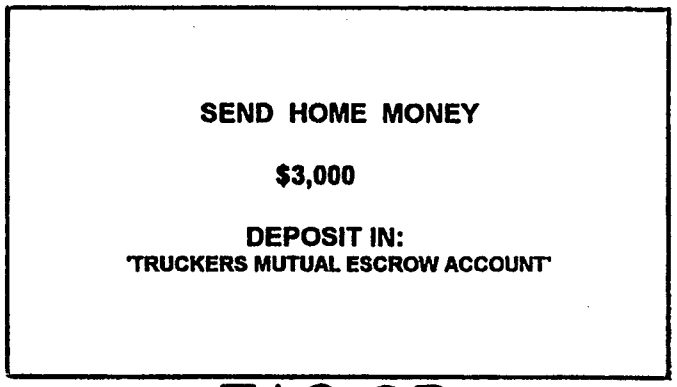

FIGS. 9A and 9B respectively show the top and bottom of one of the PENALTY VOUCHER cards 108 that is not shared in the TEAM SEPARATE mode of play. If a player draws this particular card, he would be required to send $3,000 home.

Figure 10A:
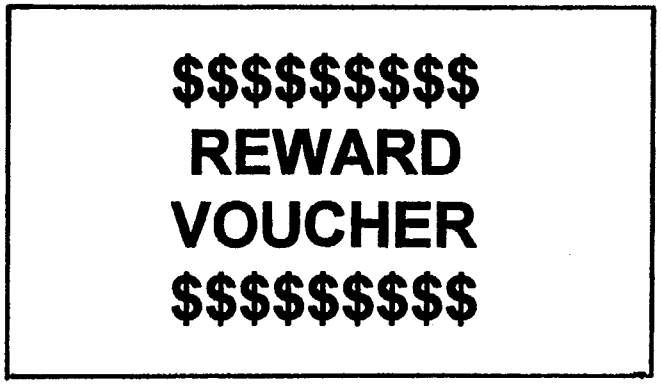
Figure 10B:
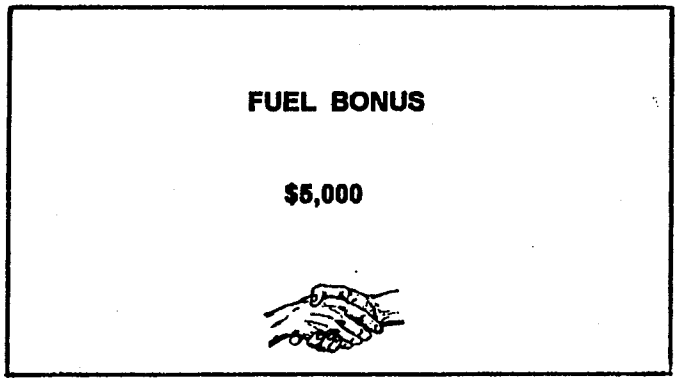

FIGS. 10A and 10B respectively show the top and bottom of one of the REWARD VOUCHER cards 106 that, as indicated by the clasped hands is to be shared in the TEAM SEPARATE mode of play. If a player draws this particular card, he receives a $5,000 fuel bonus.

Figure 11A:
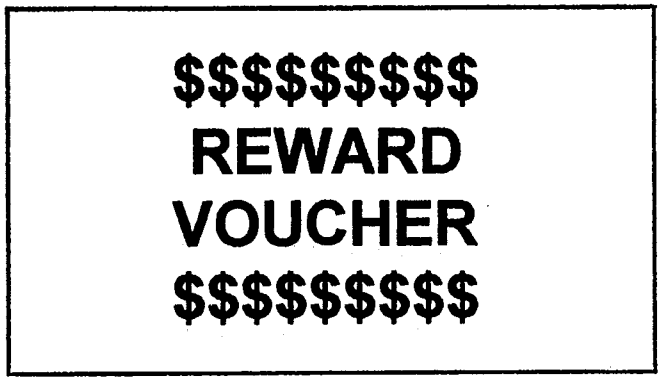
Figure 11B:
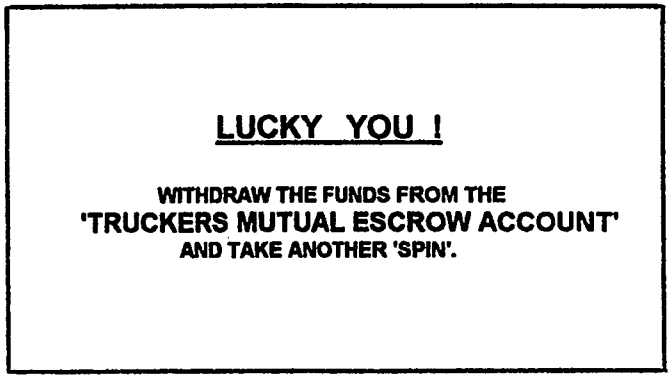

FIGS. 11A and 11B respectively show the top and bottom of one of the REWARD Voucher cards 106 that is not to be shared in the TEAM SEPARATE mode of play. If a player draws this particular card marked "LUCKY YOU", he receives all the money in the TRUCKERS MUTUAL ESCROW ACCOUNT.

Figure 12A:
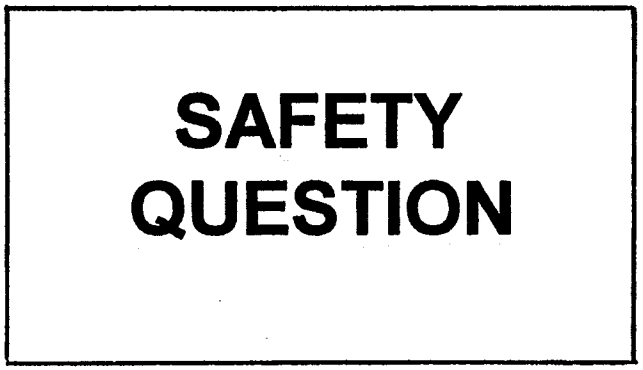
FIGS. 12A and 12B respectively illustrate opposite sides of a Safety Question card.
Figure 12B:
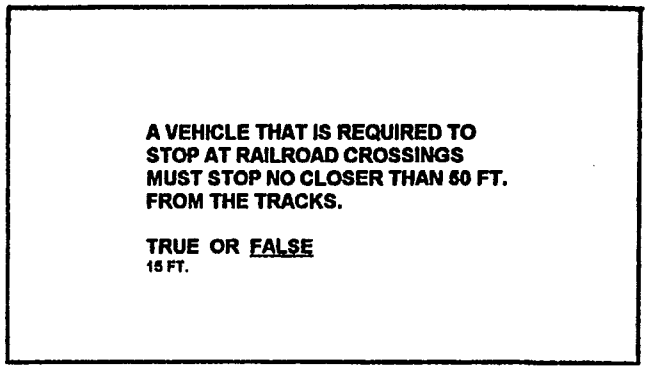

FIGS. 12A and 12B respectively show the top and bottom of a SAFETY QUESTION card from the stack 110 that is drawn when a card drawn from the stack 108 of Penalty Voucher cards so indicates.

Figure 13A:
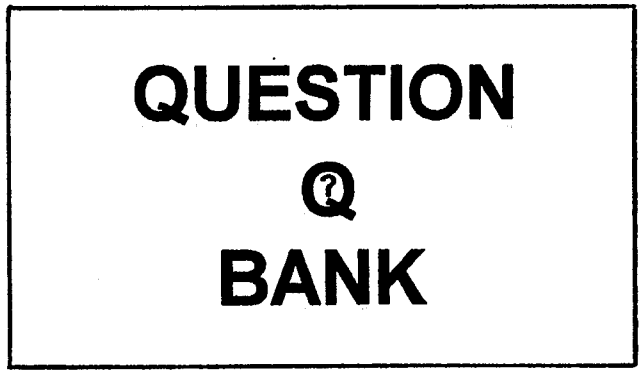
FIGS. 13A and 13B respectively illustrate opposite sides of a General Question card.
Figure 13B:
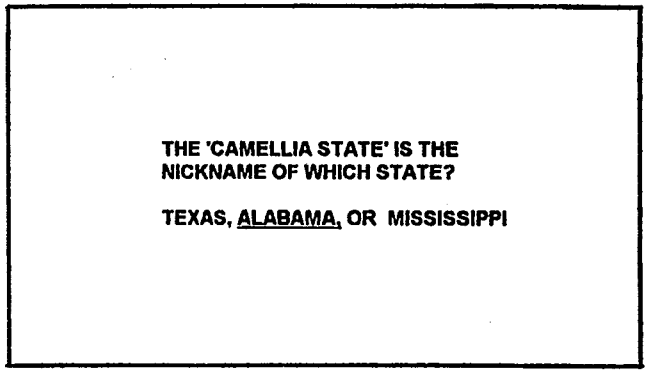

FIGS. 13A and 13B respectively show the top and bottom of a general question card in the stack 112 that is drawn when a player's truck lands on a segment marked with a Q.

Examples of REWARD VOUCHERS that may be used in the stack 100 of FIG. 2 are set forth below. The numbers of each are set forth in parentheses.

FUEL FILL UP EXEMPT VOUCHER (5) (May be held until needed or sold to another player.)

PREVENTIVE MAINTENANCE EXEMPT VOUCHER (5) (May be held until needed or sold to another player.)

DEPARTMENT OF TRANSPORTATION EXEMPT VOUCHER (5) (May be held until needed or sold to another player.)

POLICE BENEVOLENT ASSOCIATION (P.B.A.) (5) NATIONAL EXEMPT VOUCHER (May be held until needed or sold to another player.)

INTERNAL REVENUE SERVICE PRE-PAID VOUCHER (IRS) (5) (May be held until needed or sold to another player.)

ROAD SERVICE EXEMPT VOUCHER (5) (May be held until needed or sold to another player.)

OVERWEIGHT EXEMPT VOUCHER (5) (May be held until needed or sold to another player).

Examples of PENALTY VOUCHERS that may be used in the stack 108 of FIG. 2 are set forth below. The numbers of each are set forth in parentheses.

TRIP LEASE $1,000 (6) Add to: "Trucker's Mutual Escrow Account"

TRACTOR/TRAILER & CARGO INSURANCE $10,000 (6) Add to: "Trucker's Mutual Escrow Account"

SEND HOME MONEY (2 each=8)

a. $1,000
b. $2,000
c. $3,000
d. $4,000

Add to: "Trucker's Mutual Escrow Account"

BROKERS FEE (6) Add up all Contract for Cartage vouchers and pay 20% Add to: "Trucker's Mutual Escrow Account"

"FILL IT UP" (2 each=10)

a. $100
b. $200
c. $300
d. $400
e. $500

Add to: "Trucker's Mutual Escrow Account" (Fuel Fill Up Exempt Voucher accepted.)

"ROAD PERMITS" $2,500 (6)

ENGINE OVERHAUL $10,000 (6) (Preventive Maintenance Exempt Voucher accepted.)

"BINGO CARD" $5,000 (6)

"SPEED TRAP" (6) Spin Mileage Wheel and pay TEN times amount shown. ("P. B. A." National Exempt Voucher accepted.)

TRAFFIC VIOLATION $500 (2 each=12)

a. Tailgating
b. Failure to stop on red signaling device.
c. Failure to use directional turn signal when changing lanes.
d. Traveling in the left lane of a three lane highway.
e. Failure to yield the right of way.
f. Obstructing traffic. (Parking on the shoulder of an Interstate.)

("P.B.A." National Exempt Voucher accepted.)

DEPARTMENT OF TRANSPORTATION (2 each=10)

SPOT CHECK INSPECTION $5,000 a. Failure to maintain DAILY LOG
b. Mechanical Defects
c. Tire tread below accepted wear.
d. Front end suspension out of line.
e. Failure to stop at SPOT CHECK INSPECTION station.

(D.O.T. Exempt Voucher accepted.)

ROAD SERVICE $1,000 (2 each=10)

a. Blown air compressor
b. Out of fuel
c. Dead battery
d. "Blow out"
e. Engine failure (Road Service Exempt Voucher accepted.)

ANSWER SAFETY QUESTION (24)

14. INTERNAL REVENUE SERVICE—TAX BILL (1 each=5)

a. $10,000
b. $15,000
c. $20,000
d. $25,000
e. $50,000

(I.R.S. Pre-Paid Voucher accepted.)

15. PORTABLE WEIGH STATION—SPIN MILEAGE WHEEL (6) (Over weight Exempt Voucher accepted.)

16. REPEAT TURN (6) Return to previous MILE MARKER and "Keep on Truckin".

17. PREVENTIVE MAINTENANCE SERVICE $1,000 (6) (Preventive Maintenance Exempt Voucher accepted.)

Examples of Safety Questions on the cards that may be used in the stack 110 of FIG. 2 are set forth below.

An owner-operator must obey only those parts of the Federal Motor Carrier Safety Regulations which cover motor carriers.

TRUE or FALSE

They must obey both parts covering drivers and motor carriers.

The Federal Motor Carrier Safety Regulations state that a driver of a truck over 26,000 lbs. must be at least 18 years old.

TRUE OR FALSE

A driver must be at least 21 years old.

After the first conviction of a Felony involving a commercial motor vehicle, a driver may not drive any motor vehicle for one year.

TRUE OR FALSE

After the first conviction of leaving a scene of an accident which resulted in personal injury or death, a driver may not drive any motor vehicle for one year.

TRUE OR FALSE

After the first conviction of operating a commercial vehicle under the influence of alcohol or drugs (narcotics), a driver may not drive any motor vehicle for one year.

TRUE OR FALSE

Every driver must include in their employment application, a list of names and addresses of all employers during the previous 10 years.

TRUE OR FALSE

At least once every 3 years a driver must fill out a form listing all motor vehicle violation convictions during the previous year.

TRUE OR FALSE

At least once a year.

A driver must fill out the form listing all motor vehicle violation convictions for the previous year even if there were no violations.

TRUE OR FALSE

If a new driver applicant has a valid certificate showing successful completion of a driver's road test, the employer may still require the applicant to take a road test.

TRUE OR FALSE

If a new driver applicant has a valid certificate showing successful completion of a driver's road test, the employer must accept.

TRUE OR FALSE

The employer may still require the driver applicant to take a road test.

A person with breathing problems which may affect safe operation of a motor vehicle may not drive except on short runs.

TRUE OR FALSE

They cannot drive.

Unless the vehicle has an emergency oxygen supply, a person with breathing problems which may affect safe operation of a motor vehicle, may not drive.

TRUE OR FALSE

They cannot drive.

A driver may not drive faster than the posted speed limit unless they are passing another vehicle.

TRUE OR FALSE

Examples of general questions that may be used on the cards in stack 112 of FIG. 2 are set forth below.

What is the capital city of the State of Alabama? Montgomery

The "Camellia State" is the nickname of which state? Alabama, Mississippi or Texas What year did Alabama enter the union? Dec. 14, 1819, 1803 or 1810 Rank number 22nd The same year Mexico ceded the province of California to the United States, the famous California "Gold Rush" began; what is the year? 1848, 1838 or 1845

In which state is the "Petrified Forest" Located? Arizona, New Mexico or Texas

The "Centennial State" is the nickname of which state? Colorado, New Hampshire or Delaware In the "Mesa Verde National Park" are located the ancient dwellings of the Anasazi Indians. In which state is the Mesa Verde National Park located? Colorado, Wyoming or Utah In the Year 1848, at the end of the Mexican War, what state did the United States reclaim? Arizona, Texas or New Mexico The "Constitution State", or the "Nutmeg State" is the nickname of which state? Connecticut, Maine or New Hampshire In which state is the only diamond mine located? Arkansas, Iowa or Indiana What is the capital of the State of California? Sacramento

GENERAL RULES OF THE GAME

No U-Turns are permitted in the game. If a truck is placed on a dead end route, it must go to the end, enter the city at the end, and wait for next turn to start back.

No loans are permitted between players.

A player may only borrow money against their Title of Ownership, and only from the Truckers Credit Union.

Only full value Collateral Loans will be granted against the Title of Ownership.

All Collateral Loans against the title of ownership must be paid back at the end of the game before a winner is declared.

Hometown Bonus: When a player draws a contract for cartage voucher and their Hometown (Home Base) is listed as the delivery destination, once their truck has entered their hometown city, they are awarded $20,000, in addition to the freight charges, and on the player's next turn, after drawing a contract for cartage, may advance directly to the pick-up location listed, operate the chance mechanism and advance the number of segments shown. No bonus is awarded if the player's hometown (home base) is listed as the pick-up location.

Two or more players MAY occupy the Mile Markers or Cities at any one time throughout the play of the game.

Dead-Head placards are to be stuck on the Miniature Tractor Trailer playing tokens, when you are on your way to a Pickup destination.

Loaded placards are to be stuck on the miniature Tractor/Trailer playing Tokens, when you are on your way to the Delivery destination.

All penalties must be paid during the player's turn, or the player is considered insolvent, and BANKRUPT, and must withdraw from the game. All excess money is returned to the Truckers Credit Union.

The only time Money is exchanged between players is the selling of Exempt Vouchers drawn from the stack 106 of reward vouchers to one another.

The Trustee receives $100 from the TRUCKERS CREDIT on each turn.

A player may draw a contract for cartage voucher from any area regardless on which city their playing token lands.

The players may use any route on the board traveling from city to city.

PLAYING THE GAME

Select the TRUSTEE, (may be a player or non-player), by use of spinner or by agreement.

The players may want to set a time limit for the length of the game.

The TRUSTEE distributes the Start Up money to each player ($25,000) and places $1,000 in Trucker's Mutual Escrow Account.

Each player selects their Title of Ownership, which includes their Logo Name and Hometown and corresponding colored miniature Tractor/Trailer playing token.

Select the player to begin by use of the chance mechanism or by agreement, and continue in one direction around the board.

The first player, draws a CONTRACT FOR CARTAGE VOUCHER and spins the chance mechanism to determine the number of segments his truck is to advance toward the pick-up point in the voucher.

The player does what is indicated on the mileage segment on which his truck comes to rest on a turn.

Once a CONTRACT FOR CARTAGE VOUCHER has been fulfilled, the player holds on to the voucher until the end of the game and draws another Contract For Cartage card in his next turn.

What is claimed is:

1. A game including:

a map of a given area having a plurality of cities located thereon and road routes interconnecting them, the routes being divided into segments;

certain cities being respectively designated as home bases;

a plurality of pieces, wherein the cities that are designated as home bases are coded in different colors, and said pieces respectively have the same colors;

a plurality of contract cards, each of which has designated thereon a city at which a load is to be picked up, a city to which the load is to be delivered and the amount to be paid for hauling a load from one city to the other;

means for randomly determining the number of segments a piece is to be moved; and play money.

2. A game as set forth in claim 1, wherein said segments correspond to a designated distance.

3. A game as set forth in claim 1, further comprising:

designations that a penalty is required at certain segments along said routes.

4. A game as set forth in claim 3, further comprising:

a plurality of penalty cards to be drawn when a piece terminates a turn on a segment bearing a designation of a penalty.

5. A game as set forth in claim 4, wherein said penalty cards include cards having a question and answer set forth thereon and a fine to be paid for an incorrect answer.

6. A game as set forth in claim 1, further comprising:

designations that a reward is to be received at certain segments along said routes.

7. A game as set forth in claim 6, further comprising:

a plurality of reward cards to be drawn when a piece terminates a turn on a segment bearing a designation of a reward.

8. A game as set forth in claim 1, further comprising:

designations on certain of said segments indicating that a question is to be answered, a reward given for a correct answer, and a penalty given for an incorrect answer.

9. A game as set forth in claim 8, wherein at least some of said routes meet at intersections, and said segments indicating that a question is to be answered occur at said intersections.

10. A game as set forth in claim 1, further comprising:

segments along said routes being designated as weigh stations; and said means including a spinner for randomly determining the number of segments a piece is to be moved also randomly indicates excess weight and the penalty therefor.

11. A game as set forth in claim 10, wherein said means for randomly indicating excess weights includes an indication that the excess weight is zero and that no penalty is required.

12. A game as set forth in claim 1, further comprising:

segments along said routes being designated as truck stops; and said means for randomly determining the number of segments a piece is to be moved is a spinner that also randomly indicates sums to be received at a truck stop.

13. A game as set forth in claim 1, wherein said means for randomly determining the number of segments a piece is to be moved along a route is a spinner that is adapted for randomly determining penalties for excess weights when a piece comes to rest on a segment marked WEIGH STATION, and randomly determining sums to be received when a piece comes to rest on a segment marked TRUCK STOP.

14. A game as set forth in claim 1, wherein said means for determining by chance includes a spinner adapted to indicate that a bonus is to be received.

15. A game as set forth in claim 1, further comprising:

lines on said map dividing said area into a plurality of zones;

said contract cards being divided into groups respectively designated for said zones, the cards of each group designating a city in its zone as a point where a load is to be picked up.

16. A game as set forth in claim 15, wherein said cards designated for one zone also designate destinations in another zone.

17. A game as set forth in claim 15, wherein:

each of said areas includes the outlines of the contiguous states of the U.S.A.;

said routes coincide with interstate highways; and said zones are the western, central and eastern zones of the U.S.A.

18. A game as set forth in claim 15 wherein:

said contract cards have groups respectively designated for said western, central, and eastern zones, each card designating a city within its zone as a place where a load is to be picked up and a city in another zone as a place where a load is to be delivered.

19. A game as set forth in claim 1, further comprising:

means in said pieces to which an indicator may be attached; and a plurality of indicators for attachment to the pieces when they are not being moved in accordance with a contract card.

20. A game as set forth in claim 1, wherein said segments represent equal distances.

21. A game as set forth in claim 1, wherein said pieces are related to respective players, who start the game at a respective home base city.

22. A game including:

a map of a given area having a plurality of cities located thereon and road routes interconnecting them, the routes being divided into segments;

certain cities being respectively designated as home bases;

a plurality of pieces;

a plurality of contract cards, each of which has designated thereon a city at which a load is to be picked up, a city to which the load is to be delivered and the amount to be paid for hauling a load from one city to the other;

means for randomly determining the number of segments a piece is to be moved;

play money;

said area being comprised of a plurality of zones; and said contract cards being comprised of groups respectively designated for said zones, the designated city at which a load is to be picked up for each group of cards being a city in its zone.

23. A game as set forth in claim 22 wherein said groups of cards for each zone designate a city in another zone to which the load is to be delivered.

24. A game as set forth in claim 22 wherein:

each of said zones includes the outlines of the contiguous states of the United States of America that are within it;

said routes coincide with interstate highways; and said zones are western, central and eastern portions of the United States.

25. A game as set forth in claim 24 wherein:

the groups of said contract cards are respectively designated for said western, central and eastern zones, each card designating a city in another zone as a place where a load is to be delivered.

26. A game including:

a map of a given area having a plurality of cities located thereon and road routes interconnecting them, the routes being divided into segments;

certain cities being respectively designated as home bases;

a plurality of pieces;

a plurality of contract cards, each of which has designated thereon a city at which a load is to be picked up, a city to which the load is to be delivered and the amount to be paid for hauling a load from one city to the other;

means for randomly determining the number of segments a piece is to be moved;

a group of reward cards;

a group of penalty cards;

segments indicating that a reward card is to be drawn;

segments indicating that a penalty card is to be drawn;

a group of question cards having questions and answers therefor; and one of said reward cards and said penalty cards indicating that a card is to be drawn from said group of question cards.

27. A game as set forth in claim 26 further comprising:

another group of question cards having questions and answers therefor; and segments indicating that a card is to be drawn from said another group of cards.

28. A game as set forth in claim 27 further comprising:

questions on one of said groups of question cards relating to driving safety.

29. A game as set forth in claim 27 wherein said segments indicating that a card be drawn from said another group of cards are located at intersections of routes.

30. A game as set forth in claim 29 wherein the questions in one of said groups of question cards relate to driving safety.

31. A game including:

a map of a given area having a plurality of cities located thereon and road routes interconnecting them, the routes being divided into segments;

certain cities being respectively designated as home bases;

a plurality of pieces;

a plurality of contract cards, each of which has designated thereon a city at which a load is to be picked up, a city to which the load is to be delivered and the amount to be paid for hauling a load from one city to the other;

means for randomly determining the number of segments a piece is to be moved;

play money;

said area on said map being divided into separate zones; and at least one of said zones having two home bases in approximately the same relative locations with respect to its geographic center.

32. A game including:

a map of a given area having a plurality of cities located thereon and road routes interconnecting them, the routes being divided into segments;

certain cities being respectively designated as home bases;

a plurality of pieces;

a plurality of contract cards, each of which has designated thereon a city at which a load is to be picked up, a city to which the load is to be delivered and the amount to be paid for hauling a load from one city to the other;

means for randomly determining the number of segments a piece is to be moved;

play money;

said area being comprised of a plurality of zones;

a group of penalty cards some of which indicate monetary fines;

a truckers mutual escrow account into which said fines are to be deposited;

segments indicating that a card is to be drawn from said group of penalty cards; and a group of reward cards including at least one "lucky you" card indicating that the money in the truckers mutual escrow account is the reward.

33. A game including:

a map of a given area having a plurality of cities located thereon and road routes interconnecting them, the routes being divided into segments;

certain cities being respectively designated as home bases;

a plurality of pieces;

a plurality of contract cards, each of which has designated thereon a city at which a load is to be picked up, a city to which the load is to be delivered and the amount to be paid for hauling a load from one city to the other;

means for randomly determining the number of segments a piece is to be moved;

play money;

lines on said map dividing said area into a plurality of zones; and said contract cards being divided into groups respectively designated for said zones, the cards of each group designating a city in its zone as a point where a load is to be picked up.

34. A game as set forth in claim 33, wherein said cards designated for one zone also designate destinations in another zone.

35. A game as set forth in claim 33, wherein:

each of said areas includes the outlines of the contiguous states of the U.S.A.;

said routes coincide with interstate highways; and said zones are the western, central and eastern zones of the U.S.A.

36. A game as set forth in claim 35, wherein:

said contract cards have groups respectively designated for said western, central, and eastern zones, each card designating a city within its zone as a place where a load is to be picked up and a city in another zone as a place where a load is to be delivered.

* * * * *

UNITED STATES PATENT AND TRADEMARK OFFICE

CERTIFICATE OF CORRECTION

PATENT NO. : 5,380,011
DATED : January 10, 1995
INVENTOR(S) : Gregg L. Jarvis

It is certified that error appears in the above-indentified patent and that said Letters Patent is hereby corrected as shown below:

Column 13:
Claim 18, line 1, change "15" to --17--.

Signed and Sealed this

Seventh Day of March, 1995

*Attest:*

Bruce Lehman

BRUCE LEHMAN

*Attesting Officer*

*Commissioner of Patents and Trademarks*